US006644273B1

(12) United States Patent
Hagari et al.

(10) Patent No.: US 6,644,273 B1
(45) Date of Patent: Nov. 11, 2003

(54) INTERNAL COMBUSTION ENGINE CONTROL APPARATUS

(75) Inventors: Hideki Hagari, Tokyo (JP); Yasuyoshi Hori, Tokyo (JP); Akira Furuta, Tokyo (JP); Tatsuhiko Takahashi, Hyogo (JP); Shiro Yonezawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/308,077

(22) Filed: Dec. 3, 2002

(30) Foreign Application Priority Data

Jun. 24, 2002 (JP) ..... 2002-182717

(51) Int. Cl.[7] ..... F02P 5/15

(52) U.S. Cl. ..... 123/406.18; 123/406.62; 123/406.63; 123/479

(58) Field of Search ..... 123/406.18, 406.62, 123/406.63, 479

(56) References Cited

U.S. PATENT DOCUMENTS 4,664,082 A * 5/1987 Suzuki ..... 123/406.18
4,788,956 A * 12/1988 Suzuki et al. ..... 123/406.18
4,941,445 A * 7/1990 Deutsch ..... 123/406.18
4,960,092 A * 10/1990 Sasaki et al. ..... 123/406.18
5,343,842 A * 9/1994 Fukui ..... 123/406.18
5,630,396 A * 5/1997 Fukui et al. ..... 123/406.18
6,302,085 B1 * 10/2001 Sekine et al. ..... 123/406.62
6,446,602 B1 * 9/2002 Yonezawa et al. ..... 123/406.62
2002/0078925 A1 * 6/2002 Kobayashi ..... 123/479

FOREIGN PATENT DOCUMENTS

JP 07-197843 8/1995
JP 09-170484 6/1997

* cited by examiner

*Primary Examiner*—Erick Solis
(74) *Attorney, Agent, or Firm*—Sughrue Mion, PLLC

(57) ABSTRACT

An internal combustion engine control apparatus can reliably detect abnormality in a crank angle position signal to ensure a fail safe function upon occurrence of the abnormally. A fuel injection signal and an ignition signal is generated based on the result of cylinder identification performed by a cylinder identification part and the crank angle position of the crank angle position signal. An abnormality determination part determines whether the crank angle position signal is abnormal. The cylinder identification part includes a cylinder identification resetting part for resetting the current content of the cylinder identification performed by the cylinder identification part upon determination of abnormality. The cylinder identification resetting part includes a fuel injection and ignition signal stopping part for stopping the fuel injection signal and the ignition signal, and a cylinder identification information clearing part for clearing previous cylinder identification information earlier than the last crank angle position signal upon determination of abnormality.

19 Claims, 14 Drawing Sheets

FIG.8

· IN CASE OF NUMBER OF PULSES OF CRANK ANGLE POSITION SIGNAL BETWEEN SUCCESSIVE LOST TEETH BEING MORE THAN THAT AT NORMAL TIME (COUNTER B75 HAVING COME EARLIER THAN LOST TOOTH.)

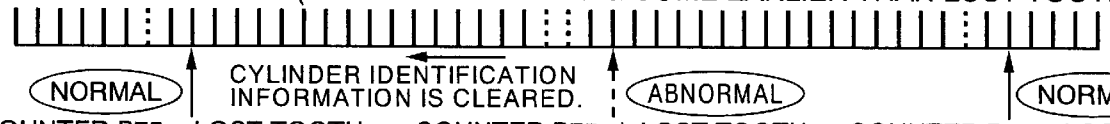

| | COUNTER B75 = LOST TOOTH | COUNTER B75 ≠ LOST TOOTH | COUNTER B75 = LOST TOOTH |
|---|---|---|---|
| CRKFAIL | CLEARED | SET | (CLEARED WHEN NORMAL OVER PREDETERMINED NUMBER OF STROKES) |
| REAL TIME CYLINDER IDENTIFICATION PROCESSING | EXECUTED | NOT EXECUTED | EXECUTED |
| FUEL INJECTION AND IGNITION PROCESSING | EXECUTED | NOT EXECUTED | EXECUTED |

* B75 PROCESSING IS NOT EXECUTED AT COUNTER B75.

⇒CYLINDER IDENTIFICATION RESETTING PROCESSING IS EXECUTED WHEN NUMBER OF SGTS DISAGREES UPON DETECTION OF LOST TOOTH OR WHEN NO LOST TOOTH HAS BEEN DETECTED OVER PREDETERMINED NUMBER OF STROKES.

* CYLINDER IDENTIFICATION RESETTING PROCESSING IS EXECUTED AGAIN WHEN ABNORMAL.

⇒REAL TIME CYLINDER IDENTIFICATION IS RESTARTED.

· IN CASE OF NUMBER OF PULSES OF CRANK ANGLE POSITION SIGNAL BETWEEN SUCCESSIVE LOST TEETH BEING LESS THAN THAT AT NORMAL TIME (LOST TOOTH HAVING COME EARLIER THAN COUNTER B75.)

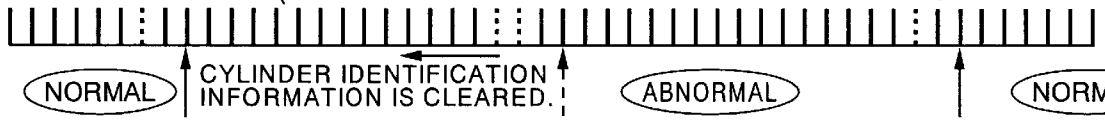

| | COUNTER B75 = LOST TOOTH | COUNTER B75 ≠ LOST TOOTH | COUNTER B75 = LOST TOOTH |
|---|---|---|---|
| CRKFAIL | CLEARED | SET | (CLEARED WHEN NORMAL OVER PREDETERMINED NUMBER OF STROKES) |
| REAL TIME CYLINDER IDENTIFICATION PROCESSING | EXECUTED | NOT EXECUTED | EXECUTED |
| FUEL INJECTION AND IGNITION PROCESSING | EXECUTED | NOT EXECUTED | EXECUTED |

⇒CYLINDER IDENTIFICATION RESETTING PROCESSING IS EXECUTED WHEN NUMBER OF SGTS DISAGREES UPON DETECTION OF LOST TOOTH.

* CYLINDER IDENTIFICATION RESETTING PROCESSING IS EXECUTED AGAIN WHEN ABNORMAL.

⇒REAL TIME CYLINDER IDENTIFICATION IS RESTARTED.

FIG.13

· IN CASE OF NUMBER OF PULSES OF CRANK ANGLE POSITION SIGNAL BETWEEN SUCCESSIVE LOST TEETH BEING MORE THAN THAT AT NORMAL TIME (COUNTER B75 HAVING COME EARLIER THAN LOST TOOTH)

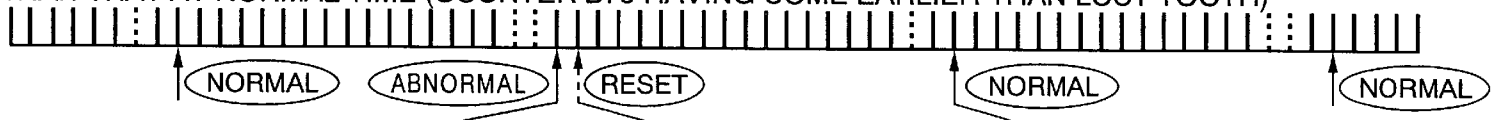

| | COUNTER B75 = LOST TOOTH | COUNTER B75 ≠ LOST TOOTH | | COUNTER B75 = LOST TOOTH | COUNTER B75 = LOST TOOTH |
|---|---|---|---|---|---|
| JDPOSWAIT | CLEARED | : SET AT COUNTER B75. | | : KEPT SET. | : CLEARED IF NORMAL. |
| LEARNING SEQUENCE CRANK ANGLE POSITION | NORMAL | NOTHING IS DONE THOUGH ABNORMAL. | | SET TO B75 UPON DETECTION OF LOST TOOTH. | NORMAL |
| REAL TIME CYLINDER IDENTIFICATION PROCESSING | EXECUTED | NOT EXECUTED AT LOST TOOTH DETECTED POSITION. | | NOT EXECUTED AT LOST TOOTH DETECTED POSITION. | EXECUTED |
| FUEL INJECTION AND IGNITION PROCESSING | EXECUTED | EXECUTED AT COUNTER ANGULAR POSITION. | | EXECUTED AT COUNTER ANGULAR POSITION. | EXECUTED |

* B75 PROCESSING IS EXECUTED AT COUNTER B75.

· IN CASE OF NUMBER OF PULSES OF CRANK ANGLE POSITION SIGNAL BETWEEN SUCCESSIVE LOST TEETH BEING LESS THAN THAT AT NORMAL TIME (LOST TOOTH HAVING COME EARLIER THAN COUNTER B75)

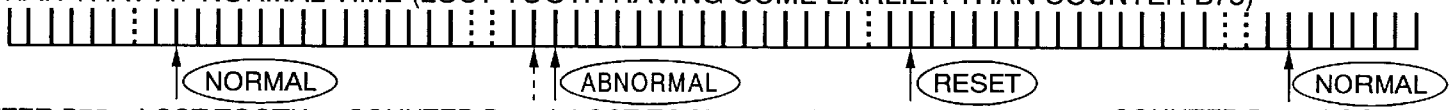

| | COUNTER B75 = LOST TOOTH | COUNTER B75 ≠ LOST TOOTH | LOST TOOTH ⇒ COUNT | COUNTER B75 = LOST TOOTH |
|---|---|---|---|---|
| JDPOSWAIT | CLEARED | SET AT LOST TOOTH DETECTED POSITION. | KEPT SET. | CLEARED IF NORMAL. |
| LEARNING SEQUENCE CRANK ANGLE POSITION | NORMAL | NOTHING IS DONE THOUGH ABNORMAL. | SET TO B75 UPON DETECTION OF LOST TOOTH. | NORMAL |
| REAL TIME CYLINDER IDENTIFICATION PROCESSING | EXECUTED | LOST TOOTH IS DISREGARDED. | NOT EXECUTED AT LOST TOOTH DETECTED POSITION. | EXECUTED |
| FUEL INJECTION AND IGNITION PROCESSING | EXECUTED | EXECUTED AT COUNTER ANGULAR POSITION. | EXECUTED AT COUNTER ANGULAR POSITION. | EXECUTED |

* B75 PROCESSING IS EXECUTED AT COUNTER B75.

* CYLINDER IDENTIFICATION RESETTING PROCESSING IS EXECUTED IF NO LOST TOOTH HAS BEEN DETECTED WHEN PREDETERMINED VALUE HAS BEEN AWAITED.

INTERNAL COMBUSTION ENGINE CONTROL APPARATUS

BACKGROUND OF THE INVENTION

1. Field of the Invention

The present invention relates to an internal combustion engine control apparatus that identifies cylinders of an internal combustion engine based on a crank angle position signal from a sensor mounted on a crankshaft and a cylinder identification signal from a sensor mounted on a camshaft, and more particularly, it relates to such an internal combustion engine control apparatus that is provided with an abnormality detection means and a fail safe function for abnormal situations.

2. Description of the Related Art

In general, in an apparatus for controlling an internal combustion engine such as an automotive engine or the like, it is necessary to optimally control the injection of fuel, the ignition timing, etc., in accordance with the operating conditions of the engine. In order to control the internal combustion engine, it is necessary to acquire a reference crank angle position signal representative of a reference crank angle position of each cylinder and a cylinder identification signal for identifying a specific cylinder.

Accordingly, for instance, a signal generation means including electromagnetic sensors is installed on rotation shafts such as a crankshaft, a camshaft, etc., of the internal combustion engine, and based on the reference crank angle position signal and the cylinder identification signal generated from the signal generation means, the reference crank angle position of each cylinder is recognized and each cylinder is identified, so that the injection of fuel and the ignition timing can be controlled with high accuracy.

That is, the conventional internal combustion engine control apparatus is provided with a crank angle sensor mounted on the crankshaft and a cam angle sensor mounted on the camshaft that makes one revolution every two revolutions of the crankshaft.

The crank angle sensor outputs a pulse-shaped crank angle position signal at prescribed crank angle intervals (for instance, at every 10° crank angle (CA)) corresponding to projections on the outer periphery of a ring gear mounted on the crankshaft, and the cam angle sensor outputs a cylinder identification signal corresponding to each cylinder.

In addition, there has been proposed such an apparatus in which an untoothed or lost tooth portion (for instance, corresponding to 30° CA) is provided in a part of a crank angle position signal, and which is capable of performing accurate cylinder identification by detecting a reference crank angle position corresponding to this untoothed portion and using it in combination with a cylinder identification signal.

A reference crank angle position detection means related to a crank angle sensor detects the reference crank angle position in real time, and a cylinder identification signal generation means related to a cam angle sensor generates a cylinder identification signal in real time.

Moreover, a cylinder identification means related to the reference crank angle position detection means and the cylinder identification signal generation means performs cylinder identification in response to the reference crank angle position signal and the cylinder identification signal in real time.

However, if there would take place abnormality in either of the crank angle position signal or the cylinder identification signal, the detection of the crank angle position and the identification of each cylinder could not be carried out correctly.

Thus, when abnormality occurs in either of the crank angle position signal or the cylinder identification signal, it is necessary to detect the state of abnormality occurrence at once and perform fail safe processing so as to avoid miscontrol on the internal combustion engine.

There has been known an internal combustion engine control apparatus with such a fail safe processing function which is described in Japanese Patent Application Laid-Open No. Hei 7-197843 for instance.

In the conventional apparatus as set forth in this document, even when the superposition of noise or signal dropout are generated in the crank angle position signal, the reference crank angle position is redetermined based on the untoothed or lost tooth portion, so that the cylinder numbers are re-set according to the number of pulses of the crank angle position signal between the lost teeth upon the redetermination of the reference crank angle position, thus preventing the identified cylinder number from being shifted and hence made incorrect.

Moreover, in another conventional apparatus such as, for example, the one described in Japanese Patent Application Laid-Open No. Hei 9-170484, the number of pulses of the crank angle position signal between successive input timings of the cylinder identification signal is counted so that the number of pulses thus counted is compared with a prescribed determination value thereby to make a determination as to whether there is abnormality in the cylinder identification signal.

However, it is thought that with respect to the crank angle position signal and the cylinder identification signal, noise superposition, signal dropouts or the like may take place not only sporadically but also successively or intermittently.

For instance, according to the above-mentioned Japanese Patent Application Laid-Open No. Hei 7-197843, when there sporadically takes place noise superposition or signal dropout in the crank angle position signal, it is possible to prevent a shift of the cylinder numbers.

However, according to the method described in the Japanese Patent Application Laid-Open No. Hei 7-197843, when there occurs noise superposition or signal dropout successively or intermittently by some causes, the injection of fuel and the ignition timing might be controlled on incorrect cylinders (or at incorrect timing), and if the ignition control would be carried out on incorrect cylinders (or at incorrect timing), it could cause backfiring, engine damage, etc.

Further, in the method described in the other Japanese Patent Application Laid-Open No. Hei 9-170484, since it is presupposed that the crank angle position signal be normal, it is necessary to determine in which of the crank angle position signal and the cylinder identification signal there has taken place abnormality. Besides, there has been no description at all about fail safe processing needed upon abnormality determination.

As described above, the conventional internal combustion engine control apparatuses have a problem that they cannot detect abnormality (noise superposition, signal dropout, etc.) that might occur in the crank angle position signal and the cylinder identification signal with high reliability, and that no fail safe function can be ensured upon occurrence of abnormally.

Specifically, the conventional apparatus according to Japanese Patent Application Laid-Open No. Hei 7-197843 involves a problem that when noise superposition or signal dropout in the crank angle position signal takes place successively or intermittently, the injection of fuel and the ignition timing might be mis-controlled, which would cause backfiring or engine damage especially when such mis-control is performed with respect to ignition control.

On the other hand, the conventional apparatus according to Japanese Patent Application Laid-Open No. Hei 9-170484 has a problem that it is necessary to determine in which of the crank angle position signal and the cylinder identification signal there has taken place abnormality, and that no consideration is given to the fail safe processing which is needed when a determination of the presence of abnormality is made, and hence it is impossible to ensure a fail safe function upon occurrence of abnormally.

SUMMARY OF THE INVENTION

The present invention is intended to solve the problems as referred to above, and has for its object to provide an internal combustion engine control apparatus which is capable of detecting a state of abnormality (noise superposition, signal dropout, etc.) that might be generated in a crank angle position signal or a cylinder identification signal with high reliability, thereby making it possible to ensure a fail safe function upon occurrence of abnormally.

Another object of the present invention is to provide an internal combustion engine control apparatus which is capable of continuing the operation of an internal combustion engine while preventing the crank angle position and cylinder identification from being misjudged when a state of abnormality in the crank angle position signal or in the cylinder identification signal has taken place sporadically.

A further object of the present invention is to provide an internal combustion engine control apparatus which is capable of promptly stopping the engine when a state of abnormality has taken place successively (i.e., when backfiring or engine damage might be caused if the operation of the engine is continued).

A still further object of the present invention is to provide an internal combustion engine control apparatus which is equipped with an abnormality detection means and a fail safe function by which when a state of abnormality has taken place intermittently, a minimum limp home capability can be ensured by continuing fuel injection control and ignition timing control on the cylinder(s) or period(s) of time for which the cylinder identification is correctly carried out.

Bearing the above objects in mind, the present invention reside in an internal combustion engine control apparatus for identifying a plurality of cylinders of an internal combustion engine to control the injection of fuel and ignition timing with respect to each of the cylinders. The apparatus includes: a crank angle position signal generator mounted on a crankshaft of the internal combustion engine for generating a crank angle position signal in the form of a train of a plurality of pulses corresponding to a plurality of rotational angle positions of the crankshaft; a cylinder identification signal generator mounted on a camshaft that rotates at a rate of one revolution per two revolutions of the crankshaft for generating a cylinder identification signal in the form of a train of a plurality of pulses corresponding to a plurality of rotational angle positions of the camshaft, and to the cylinders. A reference crank angle position detector detects reference crank angle positions included in the crank angle position signal. A cylinder identification part identifies each of the cylinders based on the cylinder identification signal. A cylinder control part generates a fuel injection signal and an ignition signal with respect to each of the cylinders based on the result of cylinder identification performed by the cylinder identification part and the crank angle position of the crank angle position signal. An abnormality determination part determines the presence or absence of abnormality at least in the crank angle position signal. The cylinder identification part includes a cylinder identification resetting part for resetting the current cylinder identification content of the cylinder identification part when it is determined that the crank angle position signal is abnormal. The cylinder identification resetting part includes: a fuel injection and ignition signal stopping part for stopping the fuel injection signal and the ignition signal; and a cylinder identification information clearing part for clearing previous cylinder identification information earlier than the last crank angle position signal at the time of the determination of abnormality.

According to the present invention, it is possible to detect an abnormal state (noise superposition, signal dropouts, etc.) that might be generated in the crank angle position signal, thereby making it possible to ensure a fail safe function upon occurrence of abnormality in the crank angle position signal.

The above and other objects, features and advantages of the present invention will become more readily apparent to those skilled in the art from the following detailed description of preferred embodiments of the present invention taken in conjunction with the accompanying drawings.

BRIEF DESCRIPTION OF THE DRAWINGS

FIG. 8 is an explanatory view illustrating the content of real time processing in the presence of abnormality in the crank angle position signal in relation to a timing chart according to the first embodiment of the present invention.

FIG. 13 is an explanatory view illustrating the content of processing in the presence of abnormality in the crank angle position signal of the learning sequence in relation to a timing chart according to the first embodiment of the present invention.

DESCRIPTION OF THE PREFERRED EMBODIMENT

Hereinafter, a preferred embodiment of the present invention will be described in detail while referring to the accompanying drawings.

Embodiment 1

Figure 1:
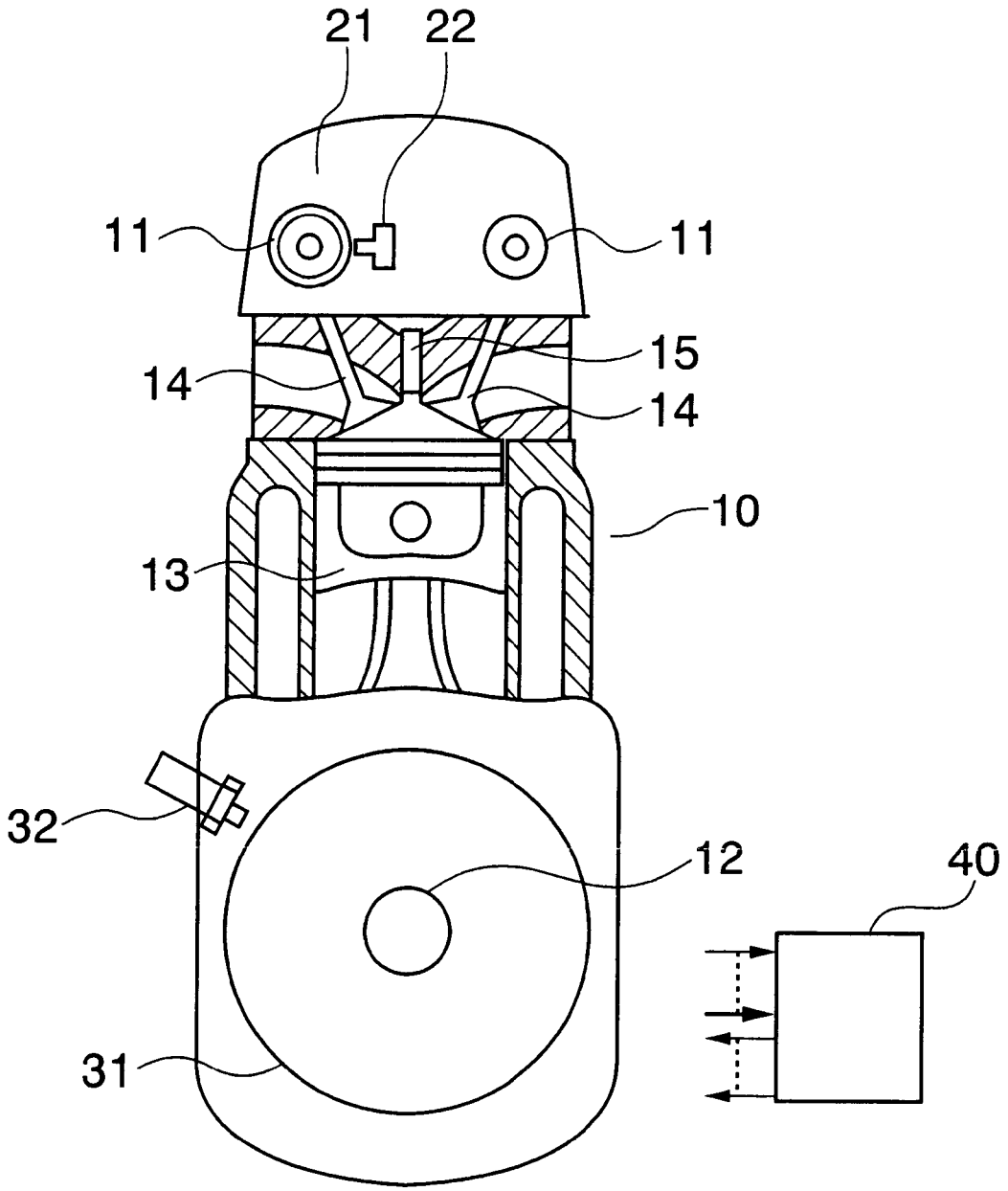
FIG. 1 is a view illustrating the construction of a control part for an internal combustion engine according to a first embodiment of the present invention.

FIG. 1 is a constructional view illustrating major portions of an internal combustion engine control apparatus according to a first embodiment of the present invention.

In FIG. 1, an internal combustion engine 10, which is hereinafter simply referred to as an engine, includes a piston 13 slidably received in each of cylinders (only one being illustrated) for driving camshafts 11 and a common crankshaft 12, an intake valve 14 and an exhaust valve 14 arranged in each cylinder head for introducing therein and exhausting therefrom an air fuel mixture, and a spark plug 15 arranged in each cylinder head with its electrodes presented in a combustion chamber defined in each cylinder between the corresponding cylinder head and the corresponding piston 13.

The spark plugs 15 together with fuel injection valves (not shown) are controlled by means of a control unit 40.

The control unit 40 takes in detected information from a variety of well-known sensors (not shown) through an input circuit (not shown), and calculates control parameters of the engine 10.

The control unit 40 is constituted mainly by a microcomputer and includes, though not illustrated herein, a CPU, a ROM, a RAM, a timer, an I/O port, an I/O interface, etc.

The crankshaft 12 is driven to rotate in accordance with the reciprocating motion of the pistons 13 connected therewith.

The camshafts 11 are operatively connected with the crankshaft 12 through mechanical transmission means (not shown) such as timing belts in such a manner that they makes one revolution per two revolutions of the crankshaft 12.

A signal disk 21 of a cylinder identification signal generation means is mounted on one of the camshafts 11, and a cylinder identification sensor 22 of the magnetic pickup type or the like is arranged in a face-to-face relation with respect to the signal disk 21 for generating a cylinder identification signal, as will be described later.

Similarly, a signal disk 31 of a crank angle position signal generation means is mounted on the crankshaft 12, and a crank angle position sensor 32 of the magnetic pickup type or the like is arranged in a face-to-face relation with respect to the signal disk 31 for generating a crank angle position signal, as will be described later.

Figure 2:
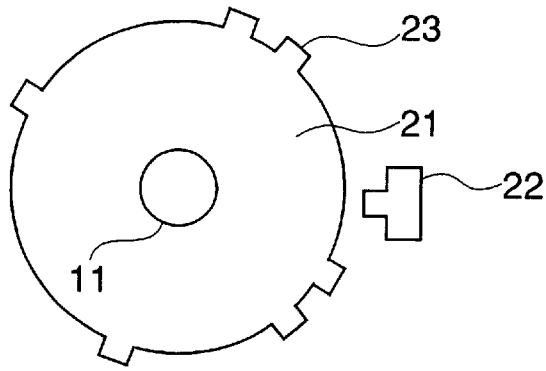
FIG. 2 is a side elevational view illustrating the configuration of a signal disk of a cylinder identification signal generation means mounted on a camshaft in FIG. 1.
Figure 3:
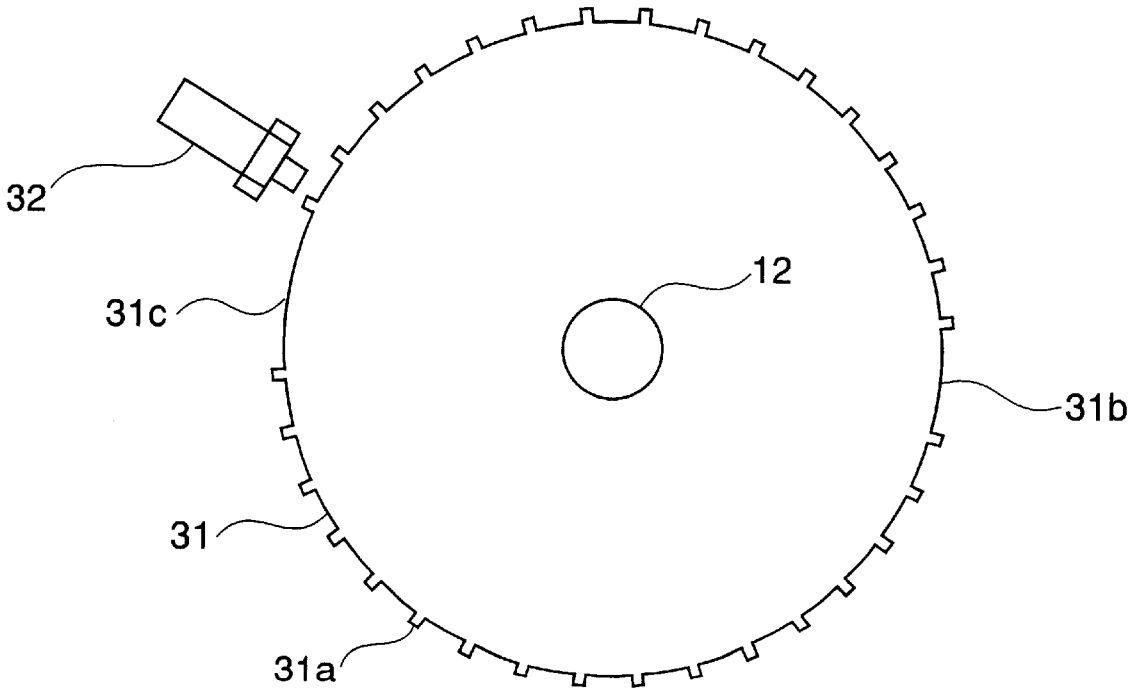
FIG. 3 is a side elevational view illustrating the configuration of a signal disk of a crank angle position signal generation means mounted on a crankshaft in FIG. 1.

FIG. 2 is a side elevational view that concretely shows the outer peripheral configuration of the signal disk 21 of the cylinder identification signal generation means, and FIG. 3 is a side elevational view that concretely shows the outer peripheral configuration of the signal disk 31 of the crank angle position signal generation means.

In FIG. 2, a plurality of projections 23 are formed along and on the outer periphery of the signal disk 21 of the cylinder identification signal generation means in an asymmetrical manner.

In FIG. 3, a multitude of projections 31*a*, which are called a ring gear, are arranged along and on the outer periphery of the signal disk 31 of the crank angle position signal generation means substantially at equal intervals.

In addition, untoothed or lost tooth portions 31*b* and 31*c*, at each of which a projection or projections 31*a* is or are missed or lost, are arranged on the outer periphery of the signal disk 31 with their angles being different from each other.

For instance, the crank angle of the untoothed portion 31*b* (i.e., an angle thereof with respect to the crankshaft) is set to be 20° and the crank angle of the untoothed portion 31*c* is set to be 30°, as will be described later.

In FIG. 1 through FIG. 3, as the engine 10 is started to rotate, the signal disk 31 of the crank angle position signal generation means mounted on the crankshaft 12 is caused to rotate together with the crankshaft 12 so that the sensor 32 detects the projections 31*a* on the outer periphery of the signal disk 31 thereby to generate a crank angle position signal in the form of a train of pulses.

Also, at the same time, the signal disk 21 of the cylinder identification signal generation means arranged on a camshaft 11 operatively connected with the crankshaft 12 is caused to rotate by the rotation of the crankshaft 12, so that the sensor 22 detects the projections 23 on the outer periphery of the signal disk 21 thereby to generate a cylinder identification signal in the form of a train of pulses.

Figure 4:
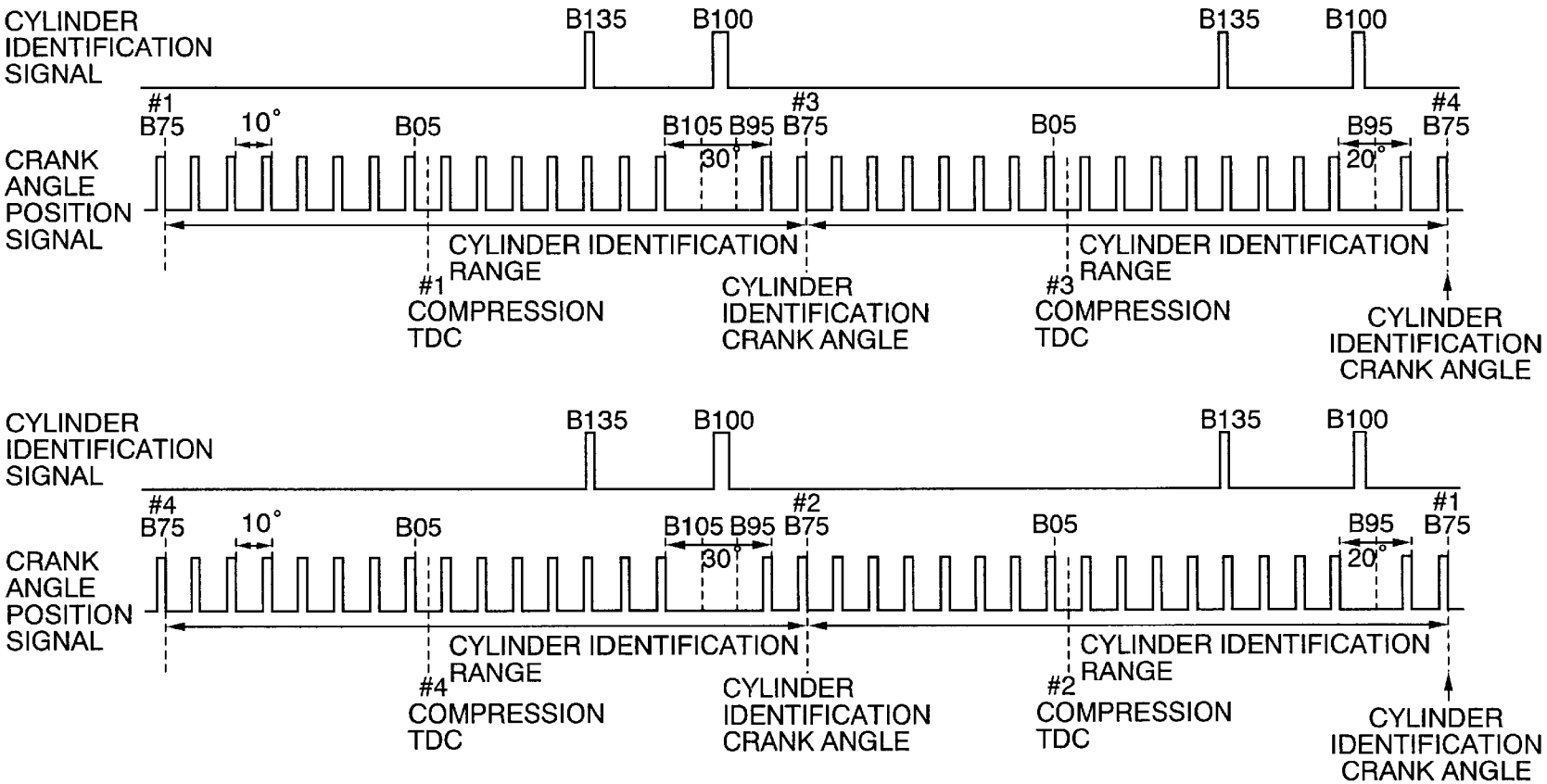
FIG. 4 is an explanatory view illustrating a crank angle position signal and a cylinder identification signal generated according to the first embodiment of the present invention in pulse patterns in a four-cylinder internal combustion engine.

FIG. 4 is a timing chart that shows the cylinder identification signal and the crank angle position signal generated by the sensors 22, 32, respectively, in FIG. 1 through FIG. 3, while illustrating concrete examples of signal patterns for a four-cylinder internal combustion engine.

In FIG. 4, the successive pulse waveforms of the cylinder identification signal and the crank angle position signal are shown expediently by being divided into an upper and a lower row, and it is assumed that four cylinders #1 through #4 are controlled in the order of #1→#3→#4→#2.

In addition, advanced crank angle positions (BTDC) before top dead center (TDC) during compression strokes (i.e., ignition-advancing angle side) are attached by "B", and retarded crank angle positions (ATDC) after top dead center during compression strokes (i.e., ignition-retarding angle side) are attached by "A".

The crank angle position signal consists of a train of pulses of every 10° CA (crank angle) corresponding to each projection 31*a*, and the untoothed portion 31*b* corresponds to a crank angle position of B95° of each of cylinders #1, #4, and the untoothed portion 31*c* corresponds to crank angle positions of B105° and B95° of each of cylinders #3, #2.

Next, the basic operation of the first embodiment of the present invention will be explained while referring to FIG. 1 through FIG. 4.

First of all, the cylinder identification signal and the crank angle position signal from the sensors 22, 32 are read into the control unit 40 of the engine 10 together with other various sensory signals (not shown).

The microcomputer in the control unit 40 performs interrupt processing for controlling the injection of fuel and the ignition timing with respect to each cylinder every time the crank angle position signal from the crank angle position sensor 32 is input to the control unit 40.

In the above-mentioned interrupt processing, the control unit 40 stores the signal pattern of the crank angle position signal and at the same time detects the untoothed portions 31*b*, 31*c*, at which the projections 31*a* are missing, and hence a reference crank angle position by measuring the time interval at which the interrupt processing is generated.

Moreover, every time the cylinder identification signal is input from the cylinder identification sensor 22 to the control unit 40, the microcomputer in the control unit 40 similarly performs interrupt processing and stores the signal pattern of the cylinder identification signal as a cylinder sequence.

Then, the control unit 40 performs cylinder identification processing from the crank angle position signal and the signal pattern of each cylinder identification range of the cylinder identification signal at each cylinder identification crank angle position and the determined crank angle position based on the reference crank angle position.

In addition, the control unit 40 is at least provided with an abnormality determination means for determining whether there is abnormality in the crank angle position signal.

Next, the crank angle position signal abnormality determination processing operation of the control unit 40 will be described below while referring to a flow chart of FIG. 5 in addition to FIG. 1 through FIG. 4.

Figure 5:
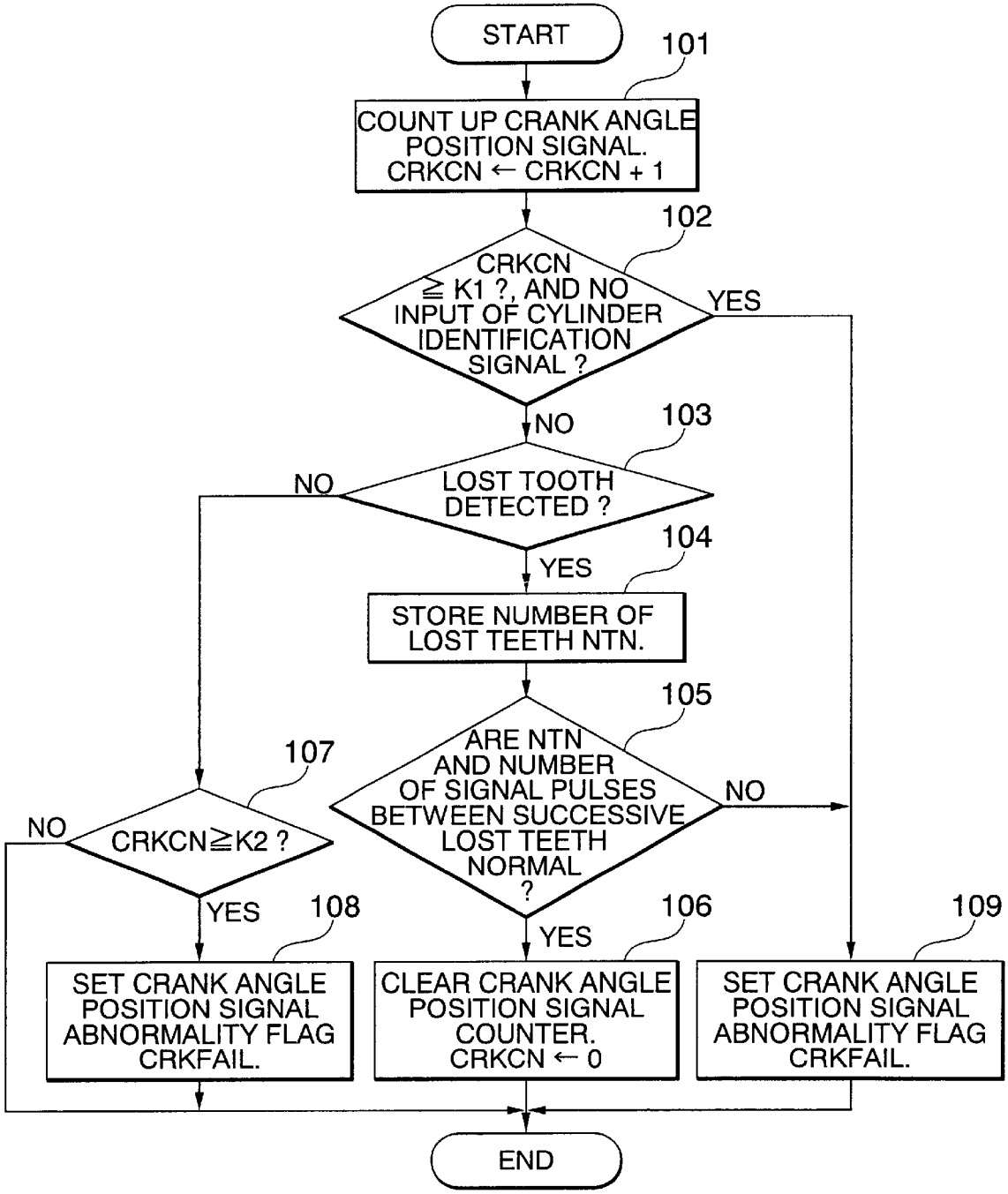
FIG. 5 is a flow chart illustrating the operation of a crank angle position signal abnormality determination routine according to the first embodiment of the present invention.

The control unit 40 includes a counter CRKCN for counting the number of pulses of the crank angle position signal, and by performing an abnormality determination routine shown in FIG. 5, it determines whether abnormality has occurred in the crank angle position signal from the crank angle position sensor 32.

The abnormality determination routine of FIG. 5 is performed in the following manner in the interrupt processing synchronized with the input timing of the above-mentioned crank angle position signal.

In FIG. 5, first of all, the interrupt processing that has been performed at the input timing of the crank angle position signal is counted, and the crank angle position signal counter CRKCN is incremented (step 101).

Then, it is determined whether the count of the crank angle position signal counter CRKCN is equal to or more than a predetermined value K1 (e.g., "17" corresponding to a prescribed crank angle range), and whether there has been no input of the cylinder identification signal over the prescribed crank angle range (step 102).

When it is determined in step 102 that CRKCN≧K1 and that there has been no input of the cylinder identification signal (that is, YES), it is assumed that abnormality has occurred in the crank angle position signal, and a crank angle position signal abnormality flag CRKFAIL is set (step 109), while ending the processing routine of FIG. 5.

On the other hand, when it is determined in step 102 that CRKCN<K1 or that there has been an input of the cylinder identification signal in a range of CRKCN≧K1 (that is, NO), it is then determined, based on the ratio of successive crank angle position signal intervals for instance, whether a lost tooth or teeth (i.e., an untoothed portion) has been detected (step 103).

When it is determined in step 103 that a lost tooth or teeth has been detected (that is, YES), the number of lost teeth NTN is stored (step 104). Thereafter, the number of lost teeth NTN and the count value of the crank angle position signal counter CRKCN are compared with predetermined values, respectively, as to determine whether they are normal (step 105).

For instance, if attention is given to the untoothed positions of B105°, B95° of cylinder #3 in the crank angle position signal pattern as shown in FIG. 4, when the last number of lost teeth NTN is 1 (NTN=1); the count of the crank angle position signal counter CRKCN from the last lost tooth to the current lost tooth is 16 (CRKCN=16); and the current number of lost teeth NTN is 2 (NTN=2), it is determined that the crank angle position signal is normal.

Also, if looking at the untoothed position of B95° of cylinder #4, when the last number of lost teeth NTN is 2 (NTN=2); the count of the crank angle position signal counter CRKCN from the last lost tooth to the current lost tooth is 17 (CRKCN=17); and the current number of lost teeth NTN is 1 (NTN=1), it is determined that the crank angle position signal is normal.

In other words, when it is determined in step 105 that both the number of lost teeth NTN and the number of signal pulses CRKCN between successive lost teeth satisfy the above-mentioned normality requirements (that is, YES), the processing routine of FIG. 5 is ended while clearing the crank angle position signal counter CRKCN to zero in order to count the number of signal pulses CRKCN until the following lost tooth is detected (step 106).

On the other hand, when in step 105, the number of lost teeth NTN or the number of signal pulses CRKCN does not satisfy the above-mentioned normality requirements, thus determining that the crank angle position signal is abnormal (that is, NO), the control flow proceeds to the above-mentioned step 109 where the crank angle position signal abnormality flag CRKFAIL is set.

Moreover, when it is determined in step 103 that the current interrupt timing is not immediately after the last lost tooth (that is, NO), a determination as to whether the state of a lost tooth being not detected continues abnormally is made depending upon whether the count of the crank angle position signal counter CRKCN is equal to or more than a predetermined number K2 (e.g., "18") (step 107).

When it is determined as CRKCN<K2 in step 107 (that is, NO), the processing routine of FIG. 5 is ended, whereas when it is determined as CRKCN≧K2 (that is, YES), it is assumed that the crank angle position signal is abnormal, and the control flow proceeds to step 108 as in step 109, where the crank angle position signal abnormality flag CRKFAIL is set, and the processing routine of FIG. 5 is ended.

Though not illustrated in FIG. 5, the crank angle position signal abnormality flag CRKFAIL is automatically cleared when the state of the crank angle position signal being normal continues a predetermined number of strokes.

Now, a fail safe processing operation upon determination of abnormality according to the first embodiment of the present invention will be described while referring to a flow chart of FIG. 6.

Figure 6:
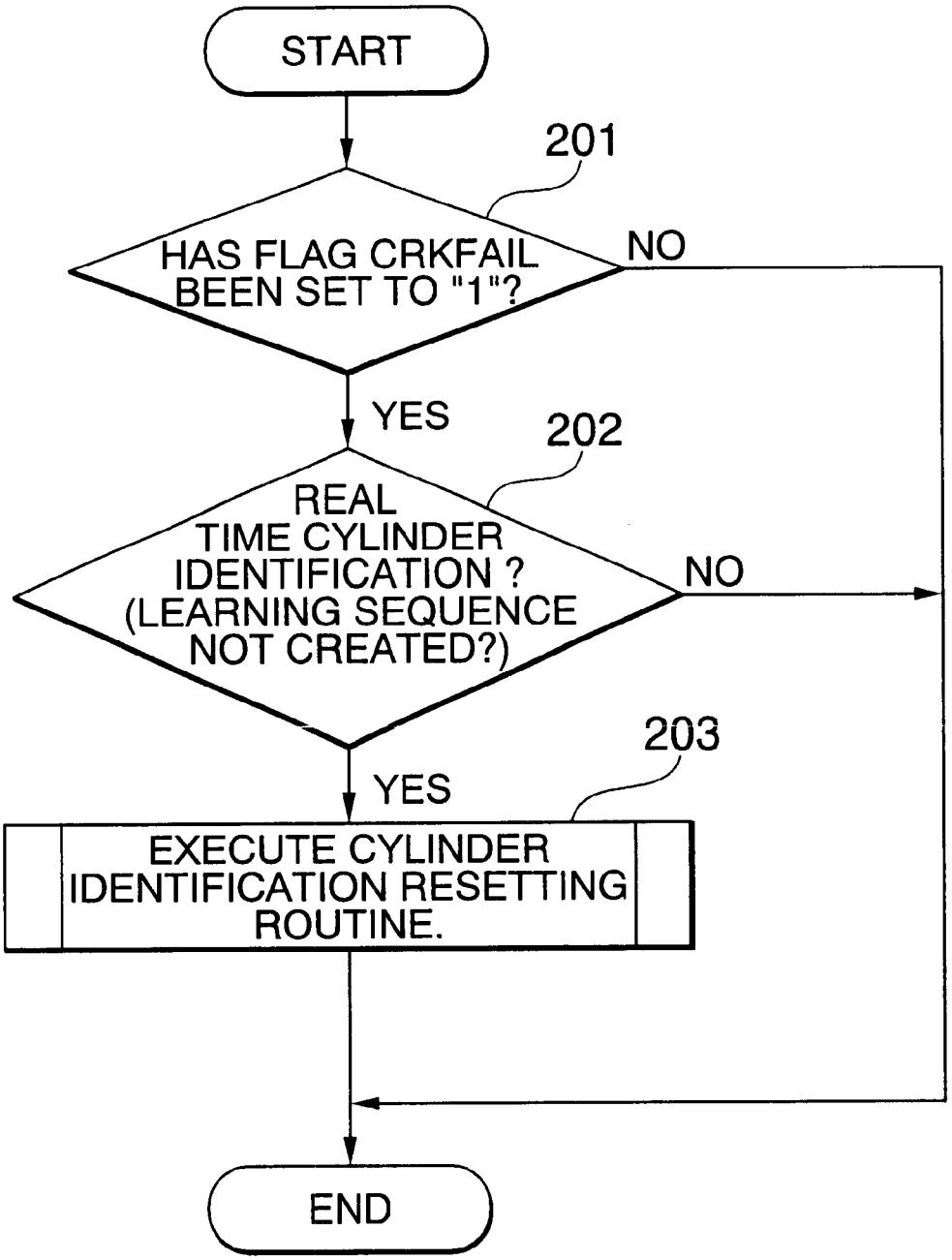
FIG. 6 is a flow chart illustrating a processing routine in the presence of abnormality in the crank angle position signal according to the first embodiment of the present invention.

The control unit 40 executes fail safe processing when determined that the crank angle position signal is abnormal, by performing a processing routine upon determination of abnormality in the crank angle position signal shown in FIG. 6.

The processing routine executed upon determination of abnormality shown in FIG. 6 is performed in the following manner in the interrupt processing executed in synchronization with the input timing of the crank angle position signal, following the above-mentioned abnormality determination routine (see FIG. 5).

First of all, it is determined whether the crank angle position signal abnormality flag CRKFAIL has been set to "1" (step 201), and when determined as CRKFAIL=0 (that is, NO), the processing routine of FIG. 6 is ended.

On the other hand, when it is determined as CRKFAIL=1 in step 201 (that is, YES), a determination is then made as to whether real time cylinder identification is being carried out (i.e., any learning sequence has not yet been created) (step 202).

At this time, when a learning sequence or the like to be described later has been created and the cylinder numbers have been updated by the learning sequence so that it is determined in step 202 that real time cylinder identification is not being carried out (that is, NO), the processing routine of FIG. 6 is ended. Hereinafter, the control flow advances to learning sequence creation processing (see FIG. 11 to be described later).

On the other hand, when it is determined in step 202 that the cylinder numbers have been updated by the real time cylinder identification (that is, YES), the following cylinder identification resetting processing routine is performed (step 203), while ending the processing routine of FIG. 6.

Next, the cylinder identification resetting processing operation (step 203 in FIG. 6) according to the first embodiment of the present invention will be described below while referring to a flow chart of FIG. 7.

Figure 7:
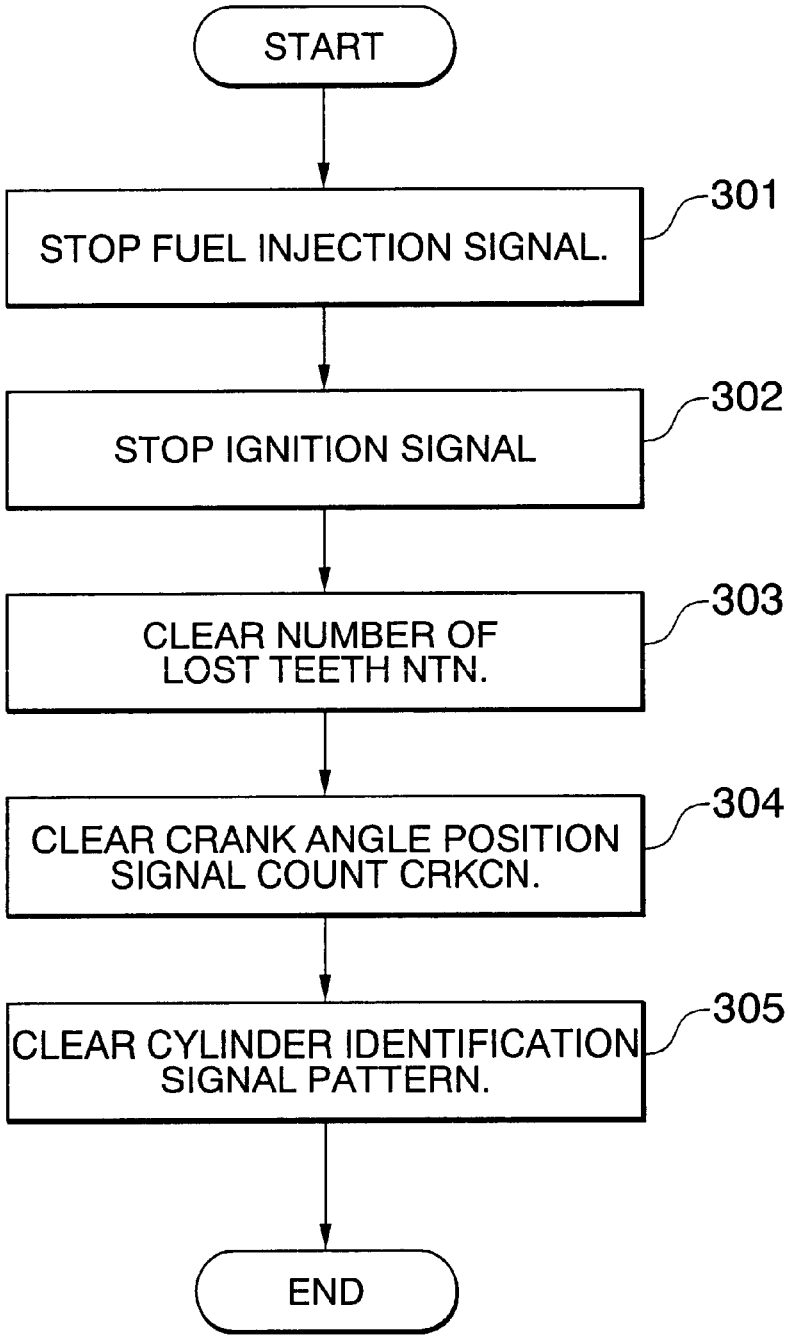
FIG. 7 is a flow chart illustrating a cylinder identification resetting processing routine according to the first embodiment of the present invention.

In FIG. 7, first of all, the fuel injection signal is stopped (step 301), the ignition signal is also stopped (step 302), and the number of lost teeth NTN is cleared (step 303).

Subsequently, the crank angle position signal counter CRKCN is cleared (step 304), and the stored cylinder identification signal pattern is cleared (step 305), waiting for the detection of the following lost tooth while ending the processing routine of FIG. 7.

FIG. 8 is an explanatory view that illustrates the processing operations of FIG. 5 through FIG. 7 while relating them to the pulse timing of the crank angle position signal, and more specifically, it shows the set state of the flag CRKFAIL, the execution state of the real time cylinder identification processing, and the execution state of the fuel injection and ignition processing at each pulse timing of the crank angle position signal.

In addition, in FIG. 8, there are shown processing operations which are performed when the number of pulses of the crank angle position signal between successive lost teeth is more than that at normal time (i.e., when the crank angle of B75° has been detected earlier than an untoothed or lost tooth position), and when the number of pulses of the crank angle position signal between successive lost teeth is less than that at normal time (i.e., when an untoothed or lost tooth position is detected earlier than the crank angle of B75°).

In the first embodiment of the present invention, cylinder identification is usually performed based on each crank angle position for lost tooth detection, as shown in the signal patterns of FIG. 4.

On the other hand, when it is determined that the position of a lost tooth detected is "abnormal" due to the fact that the crank angle of B75° does not agree with any untoothed or lost tooth position, as shown in FIG. 8, the crank angle position signal abnormality flag CRKFAIL is set, cylinder identification information is cleared by the cylinder identification resetting processing, and the real time cylinder identification processing is not performed so that the fuel injection processing and the ignition processing are not carried out, placing the fuel injection signal and the ignition signal into stopped states.

Then, if the crank angle position is normal at the following untoothed position, the fuel injection processing and the ignition processing are performed at once, so that the fuel injection control and the ignition timing control are restarted.

Thus, when there takes place abnormality in the crank angle position signal while the cylinder identification is being carried out in real time, the fuel injection signal and the ignition signal are stopped at once to protect the internal combustion engine, whereas when the crank angle position signal becomes normal, the fuel injection control and the ignition timing control are restarted at once to prevent an engine stall.

Now, a cylinder identification signal abnormality processing operation according to the first embodiment of the present invention will be described while referring to a flow chart of FIG. 9.

Figure 9:
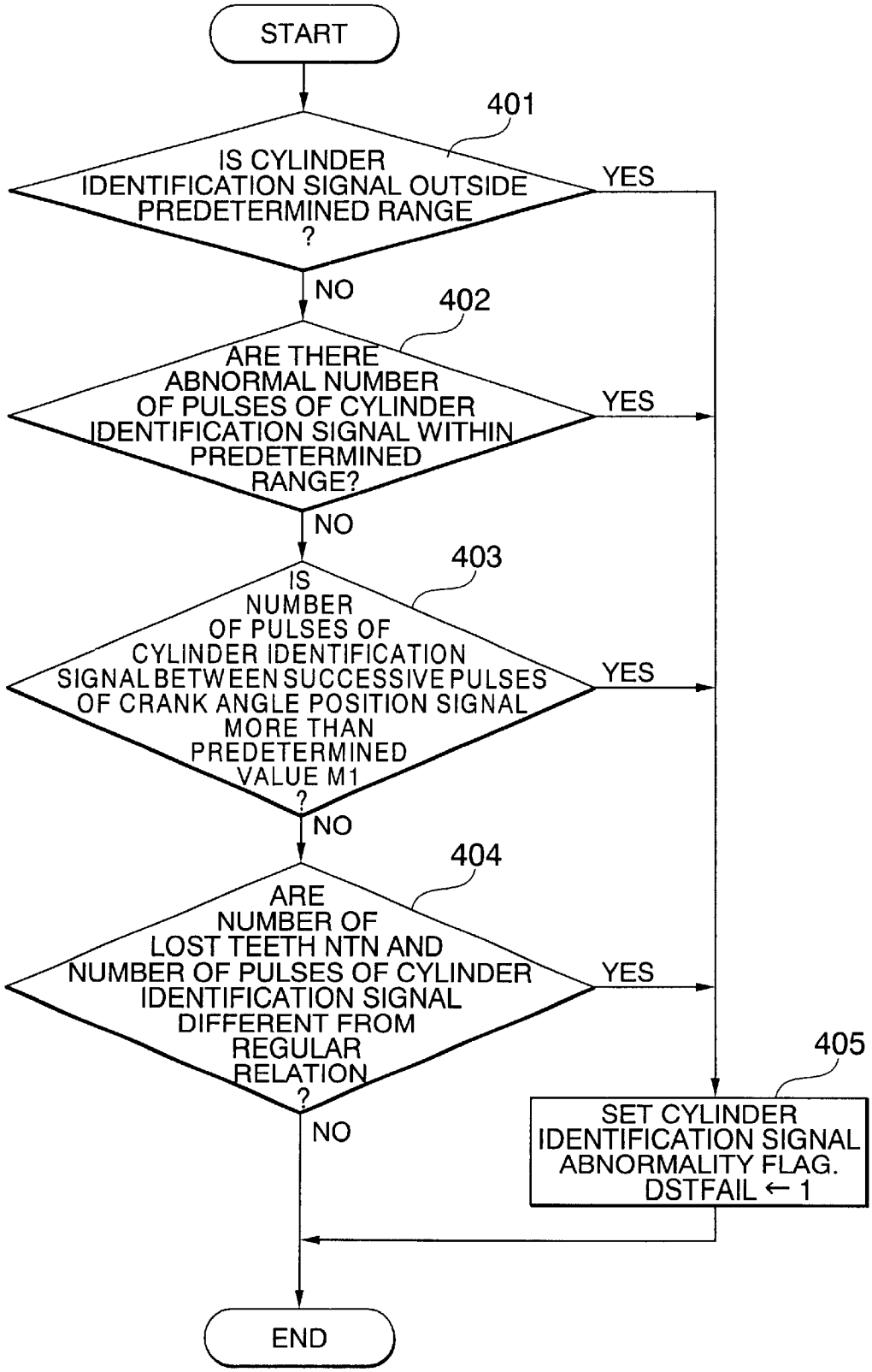
FIG. 9 is a flow chart illustrating a cylinder identification signal abnormality determination routine according to the first embodiment of the present invention.

The control unit 40 performs a cylinder identification signal abnormality determination routine shown in FIG. 9 in the interrupt processing carried out at each cylinder identification crank angle position.

In FIG. 9, first of all, the control unit 40 confirms or checks the position of the cylinder identification signal, and determines whether the cylinder identification signal is outside a predetermined range (step 401).

if it is determined in step 401 that the position of the cylinder identification signal is outside the predetermined range (that is, YES), the cylinder identification signal is assumed to be abnormal, and the cylinder identification signal abnormality flag DSTFAIL is set to "1" (step 405), while ending the processing routine of FIG. 9.

The predetermined range which is a criterion in step 401 is decided according to assembling errors between the signal disk 21 of the cylinder identification signal generation means and the cylinder identification sensor 22, an operation range within which the cylinder identification signal position may be shifted by a VVT, etc.

On the other hand, when it is determined in step 401 that the cylinder identification signal is within the predetermined range (that is, NO), then the number of pulses of the cylinder identification signal is compared with a predetermined value ("1" or "2" that is a normal number) so as to determine whether an abnormal number of cylinder identification signal pulses are detected within the predetermined range (step 402).

In step 402, when it is determined that the number of pulses of the cylinder identification signal is abnormal (that is, YES), the control flow proceeds to step 405 where the cylinder identification signal abnormality flag DSTFAIL is set.

On the other hand, in step 402, when it is determined that the number of pulses of the cylinder identification signal is normal (that is, NO), it is then determined whether the number of pulses of the cylinder identification signal between successive pulses of the crank angle position signal (e.g., 10° CA) is more than a predetermined value M1 (e.g., "2") (step 403).

In the case of the signal patterns as shown in FIG. 4, the maximum value for the number of pulses of the cylinder identification signal between successive pulses of the crank angle position signal is "1", and hence if the number of pulses of the cylinder identification signal between successive pulses of the crank angle position signal is equal to "2" or more, then it is thought that the detected pulse of the cylinder identification signal is noise. In this case, it is determined that the cylinder identification signal is abnormal (i.e., noise superposition).

In other words, in step 403, when it is determined as the number of pulses of the cylinder identification signal between successive pulses of the crank angle position signal≧M1 (that is, YES), it is assumed that abnormality has occurred in the cylinder identification signal, and the control flow proceeds to step 405 where the cylinder identification signal abnormality flag DSTFAIL is set.

On the other hand, in step 403, when it is determined that the number of pulses of the cylinder identification signal between successive pulses of the crank angle position signal is normal (that is, NO), then the number of lost teeth NTN at the crank angle position immediately after the cylinder identification signal has been detected is confirmed or checked, and it is determined whether the relation between the number of lost teeth NTN and the number of pulses of the cylinder identification signal is different from a regular relation (step 404).

For instance, in the case of the signal patterns of FIG. 4, the cylinder identification signal is assumed to be normal if the following condition or order is satisfied: that is, the number of lost teeth is "2" when the number of pulses of the cylinder identification signal is "2"; then the number of lost teeth is "1" when the number of pulses of the cylinder identification signal is "2"; subsequently the number of lost teeth is "2" when the number of pulses of the cylinder identification signal is "1"; and thereafter the number of lost teeth is "1" when the number of pulses of the cylinder identification signal is "1".

In step 404, when it is determined that the relation between the number of lost teeth NTN and the number of pulses of the cylinder identification signal is not regular (that is, YES), it is assumed that the number of pulses of the cylinder identification signal is abnormal, and the control flow proceeds to the above-mentioned step 405 where the cylinder identification signal abnormality flag DSTFAIL is set.

On the other hand, in step 404, when it is determined that the relation between the number of lost teeth NTN and the number of pulses of the cylinder identification signal is normal (that is, NO), the processing routine of FIG. 9 is ended as it is.

Now, a fail safe processing operation upon determination of abnormality in the cylinder identification signal (upon setting of the cylinder identification signal abnormality flag DSTFAIL) according to the first embodiment of the present invention will be described while referring to a flow chart of FIG. 10.

Figure 10:
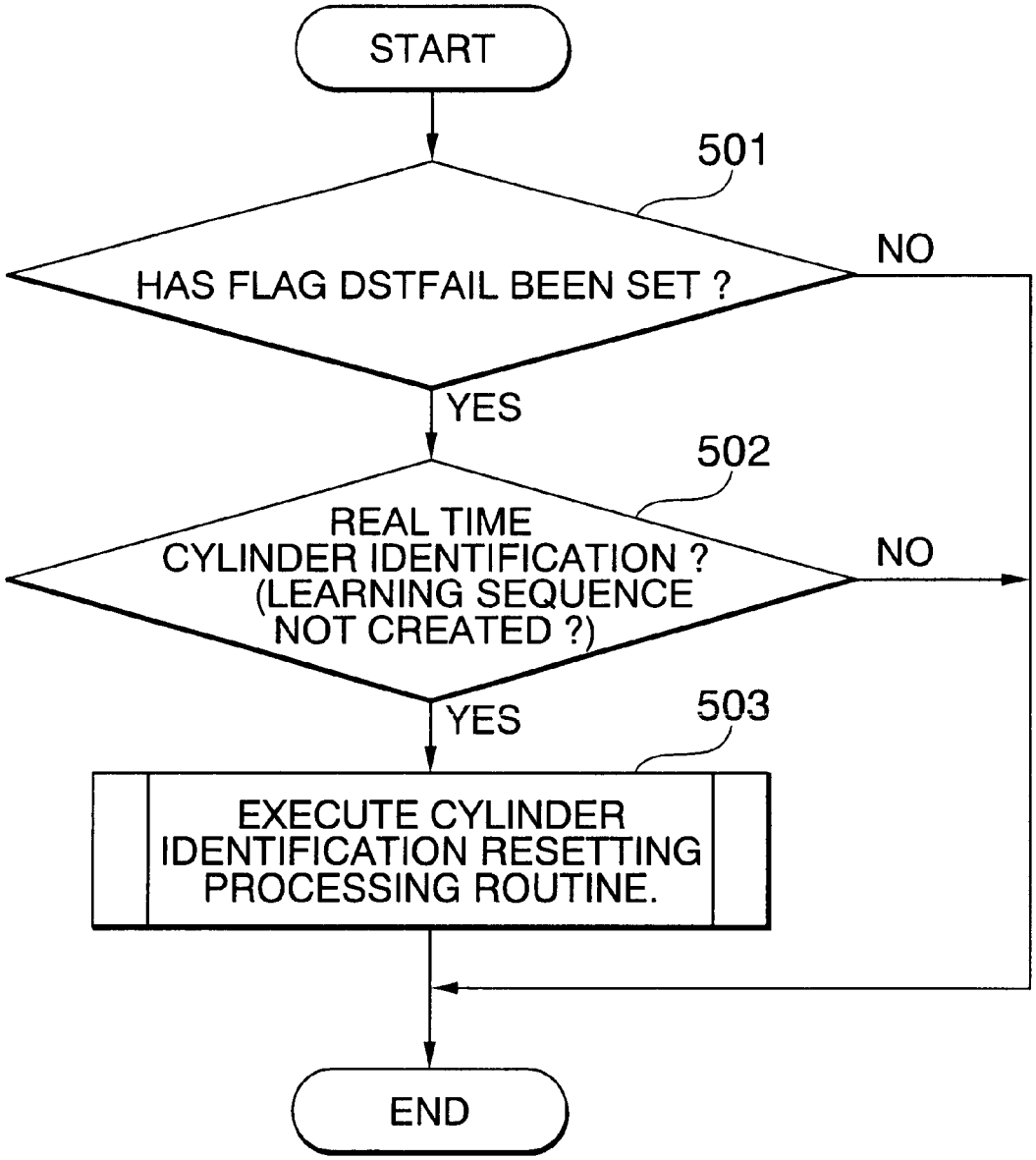
FIG. 10 is a flow chart illustrating a processing routine in the presence of abnormality in the cylinder identification signal according to the first embodiment of the present invention.

In this case, the control unit 40 executes fail safe processing when determined that the cylinder identification signal is abnormal, by performing a processing routine upon determination of abnormality in the cylinder identification signal shown in FIG. 10.

In FIG. 10, steps 502, 503 are the same processes as those in the above-mentioned steps 202, 203, respectively (see FIG. 6).

The processing routine executed upon determination of abnormality in the cylinder identification signal shown in FIG. 10 is performed in the following manner in the interrupt processing executed at each cylinder identification crank angle position, following the cylinder identification signal abnormality determination routine of FIG. 9.

In FIG. 10, first of all, the control unit 40 determines whether the cylinder identification signal abnormality flag DSTFAIL has been set (step 501), and when it is determined that the cylinder identification signal abnormality flag DSTFAIL has not yet been set (that is, NO), the processing routine of FIG. 10 is ended as it is.

On the other hand, in step 501, when it is determined that the cylinder identification signal abnormality flag DSTFAIL has been set (that is, YES), it is further determined whether real time cylinder identification is being carried out (step 502).

At this time, when a learning sequence or the like to be described later has been created so that it is determined in step 502 that real time cylinder identification is not being carried out (that is, NO), the processing routine of FIG. 10 is ended. Thereafter, the control flow advances to learning sequence creation processing (see FIG. 11 to be described later).

On the other hand, in step 502, when it is determined that the cylinder numbers have been updated by the real time cylinder identification (that is, YES), the above-mentioned cylinder identification resetting processing routine (see FIG. 7) is performed (step 503), while ending the processing routine of FIG. 10.

Thus, if the real time cylinder identification is being carried out when the cylinder identification signal is abnormal (i.e., when the flag DSTFAIL has been set), the cylinder identification resetting processing step 503 (i.e., stopping the fuel injection signal and the ignition signal, and clearing the cylinder identification information) is performed at once.

In addition, if it is determined at the following cylinder identification crank angle position that the cylinder identification signal is normal, the fuel injection control and the ignition timing control are restarted at once.

As a result, when there takes place abnormality in the cylinder identification signal while the cylinder identification is being carried out in real time, the fuel injection signal and the ignition signal are stopped at once to protect the internal combustion engine, whereas when the cylinder identification signal becomes normal, the fuel injection control and the ignition timing control are restarted at once to prevent an engine stall.

Now, a learning sequence creation processing operation according to the first embodiment of the present invention will be described while referring to a flow chart of FIG. 11.

Figure 11:
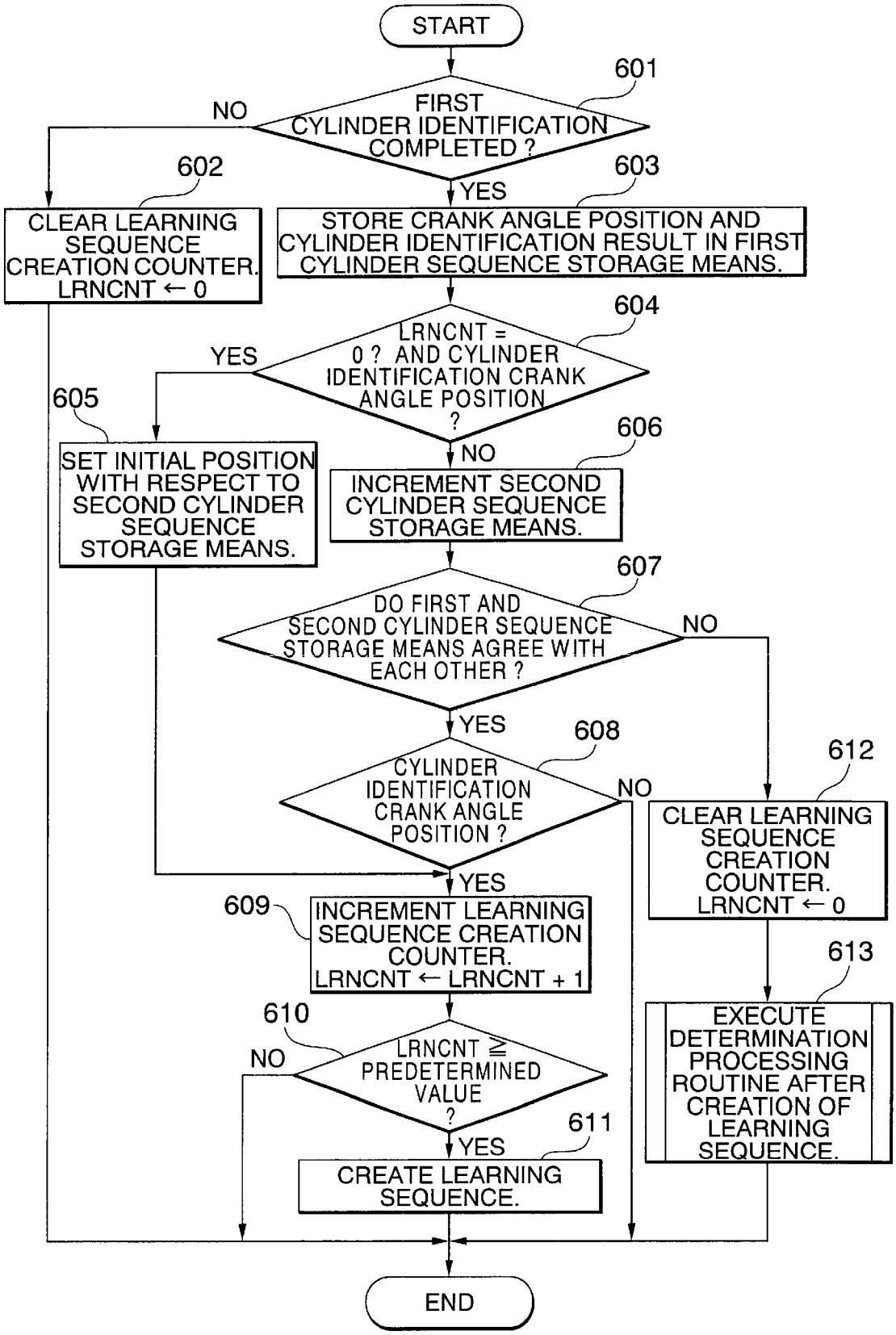
FIG. 11 is a flow chart illustrating a learning sequence generation processing routine according to the first embodiment of the present invention.

In this case, the control unit 40 includes a learning sequence creation counter LRNCNT, and performs a learning sequence creation processing routine shown in FIG. 11 to create a learning sequence when it is determined that the real time cylinder identification is normal over a predetermined period of time.

As a result, even when there has taken place abnormality in the cylinder identification signal due to noise superposition, a loss or missing of a signal pulse, etc., it is possible to carry out the normality restoration processing or the engine stop processing at once while referring to the learning sequence.

The learning sequence creation processing routine of FIG. 11 is performed in the following manner in the above-mentioned interrupt processing executed in synchronization with the input of the crank angle position signal, following the cylinder identification processing performed in real time.

In FIG. 11, first of all, the control unit 40 determines whether first cylinder identification has been completed (step 601), and when it is determined that first cylinder identification has not yet been completed (that is, NO), the processing routine of FIG. 11 is ended while clearing the learning sequence creation counter LRNCNT (step 602).

On the other hand, in step 601, when it is determined that first cylinder identification has been completed (that is, YES), the crank angle position and the cylinder identification result are stored in a first cylinder sequence storage means (step 603).

The first cylinder sequence storage means successively updates and stores the crank angle position of the crank angle position signal and the cylinder identification result obtained by the cylinder identification means.

Subsequently, it is determined whether the learning sequence creation counter LRNCNT is "0" and whether the current interruption timing is a cylinder identification crank angle position (step 604).

In step 604, when it is determined that LRNCNT=0 and that the current interruption timing is a cylinder identification crank angle position (that is, YES), since it is immediately after completion of the first cylinder identification, an initial position on a regular signal pattern is set to the second cylinder sequence storage means, which stores a regular crank angle position signal pattern and a regular cylinder sequence shown in FIG. 4, according to the current crank angle position signal and the cylinder identification result of the cylinder sequence (step 605), and the control flow proceeds to the following step 609.

On the other hand, in step 604, when it is determined as LRNCNT≧1 (that is, NO), the regular crank angle position signal pattern and the cylinder sequence in the second cylinder sequence storage means are incremented by one pulse of the crank angle position signal (step 606).

Subsequently, the cylinder sequences in the first and second cylinder sequence storage means are compared with each other to determine whether both of them are in agreement with each other (step 607). When this comparison results in a determination that the cylinder sequences in these cylinder sequence storage means do not agree with each other (that is, NO), it is assumed that abnormality has occurred in the crank angle position signal or in the cylinder identification signal, whereby the learning sequence creation counter LRNCNT is cleared to zero (step 612), and the determination processing after the learning sequence creation is performed (step 613), while ending the processing routine of FIG. 11.

On the other hand, in step 607, when it is determined that the comparison results in a determination that the cylinder sequences in these cylinder sequence storage means agree with each other (that is, YES), it is then determined whether the agreed angular position is a cylinder identification crank angle position (step 608).

In step 608, when determined that the agreed angular position is not a cylinder identification crank angle position (that is, NO), the processing routine of FIG. 11 is ended, whereas when determined that the agreed angular position is a cylinder identification crank angle position (that is, YES), the learning sequence creation counter LRNCNT is incremented (step 609).

Subsequently, it is determined whether the learning sequence creation counter LRNCNT is equal to or more than a prescribed value (e.g., a value equal to the number of cylinders "4" or more) (step 610), and when determined as LRNCNT<a predetermined value (that is, NO), a predetermined number of strokes required to create a learning sequence has not yet been reached and hence the processing routine of FIG. 11 is ended.

On the other hand, in step 611, when determined as LRNCNT≧the predetermined value (that is, YES), the cylinder sequences in the first and second cylinder sequence storage means continuously agree with each other over the predetermined number of strokes so that the agreed cylinder sequence (e.g., a second cylinder sequence) is made as a learning sequence (step 611), and the processing routine of FIG. 11 is ended.

Next, a determination processing routine (step 613) in FIG. 11 will be described below while referring to a flow chart of FIG. 12 and an explanatory view of FIG. 13.

Figure 12:
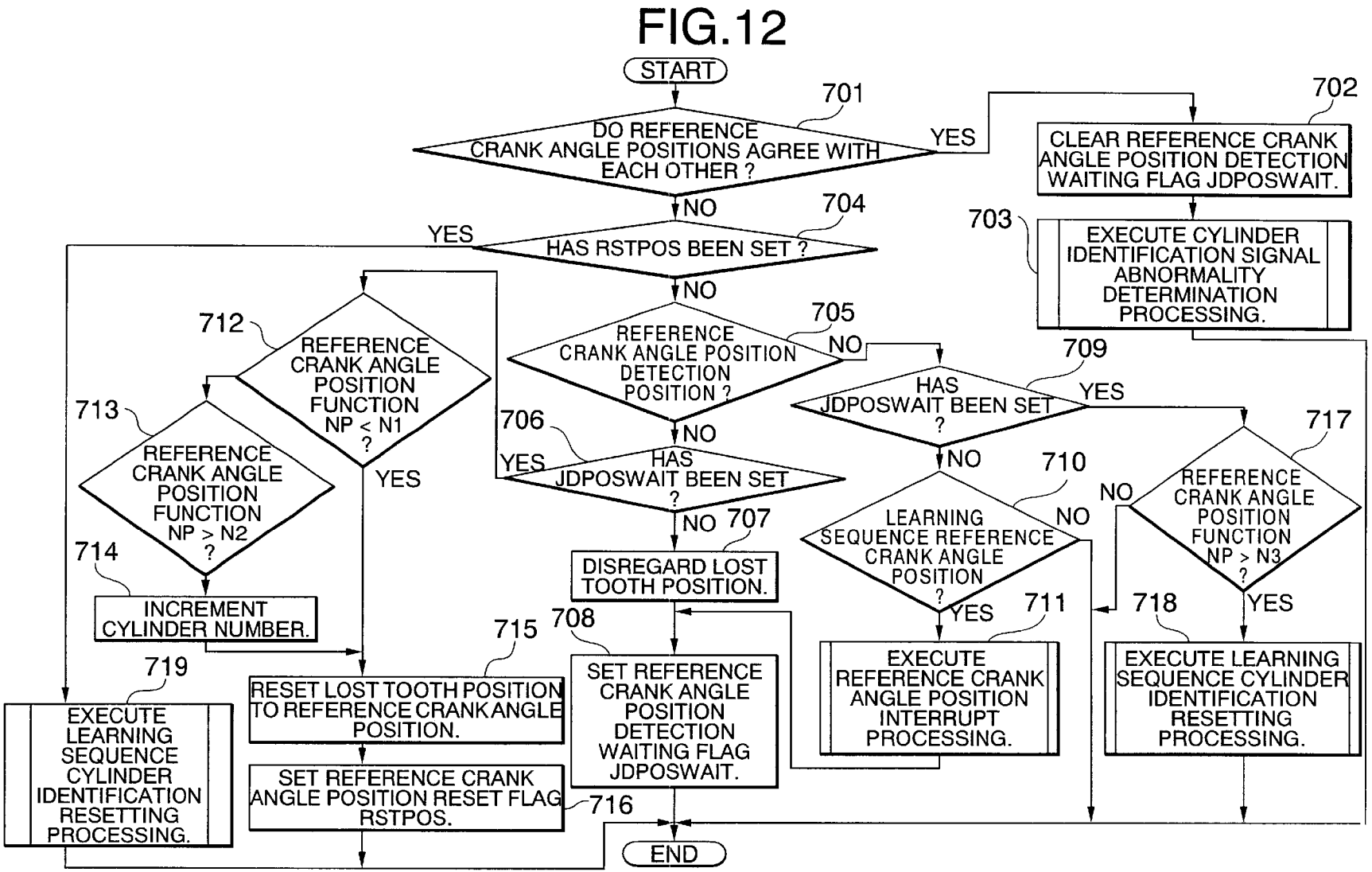
FIG. 12 is a flow chart illustrating a learning sequence abnormality determination processing routine performed when a first and a second cylinder sequence storage means are in disagreement with each other according to the first embodiment of the present invention.

FIG. 12 and FIG. 13 illustrate learning sequence abnormality determination processing executed when the first and second cylinder sequence storage means are in disagreement with each other.

When it is determined that the contents of the first and second cylinder sequence storage means are in disagreement with each other, the crank angle position signals stored in the first and second cylinder sequence storage means may disagree with each other or the cylinder identification results disagree with each other, but an explanation will be made herein by taking as an example the case where the crank angle position signals in the first and second cylinder sequence storage means disagree with each other.

FIG. 13 illustrates the processing operation of FIG. 12 in relation to the pulse timing of the crank angle position signal, as referred to above with respect to FIG. 8.

Specifically, FIG. 13 shows the set state of a reference crank angle position detection waiting flag JDPOSWAIT, the correct (true) or incorrect (false) state of the learning sequence crank angle position, the execution state of the real time cylinder identification processing, and the execution state of the fuel injection and ignition processing at each pulse timing of the crank angle position signal.

In addition, in FIG. 13, there are shown processing operations which are performed when the number of pulses of the crank angle position signal between successive lost teeth is more than that at normal time, and when the number of pulses of the crank angle position signal between successive lost teeth is less than that at normal time, as referred to before.

In FIG. 12, steps 718 and 719 are identical processing routines.

First of all, a comparison is made between the reference crank angle position based on the detection of a lost tooth and the reference crank angle position updated by a learning sequence thereby to determine whether they are in agreement with each other (step 701).

In step 701, when it is determined that the respective reference crank angle positions agree with each other (that is, YES), the reference crank angle position detection waiting flag JDPOSWAIT is cleared (step 702), and the cylinder identification signal abnormality determination processing is performed (step 703), while ending the processing routine of FIG. 12.

Note that the cylinder identification signal abnormality determination processing of the learning sequence (step 703) will be described later while referring to FIG. 15.

On the other hand, in step 701, when determined that the respective reference crank angle positions are in disagreement with each other (that is, NO), it is then determined whether a reference crank angle position reset flag RSTPOS has been set (step 704).

Here, an explanation will be made by taking, as an example in which the respective reference crank angle positions are in disagreement with each other, the case where the state in which the number of pulses of the crank angle position signal between successive lost teeth shown in FIG. 13 is more than that at normal time (i.e., the reference crank angle position B75° of the learning sequence has come earlier than an untoothed or lost tooth position) appears for the first time after creation of the learning sequence.

The reference crank angle position reset flag RSTPOS is a flag (to be described later) which is set when the reference crank angle position of the learning sequence is re-set, and it is cleared to zero at the time when disagreement between the reference crank angle positions first appears.

Therefore, in the case of the above example, it is determined as RSTPOS=0 in step 704 (that is, NO), and then a determination is made as to whether the current crank angle position is a detection position at which the reference crank angle position is detected by a lost tooth (step 705).

In this case, since the reference crank angle position according to the learning sequence appears earlier, it is determined in step 705 that the current crank angle position is not a detection position at which the reference crank angle position is detected (that is, NO), and then it is determined whether the reference crank angle position detection waiting flag JDPOSWAIT has been set (step 709).

The reference crank angle position detection waiting flag JDPOSWAIT is the flag (to be described later) which is set when the control unit 40 comes to the state of waiting for the detection of a lost tooth in order to re-set the reference crank angle position of the learning sequence, and it is cleared to zero when disagreement between the reference crank angle positions appears for the first time.

Therefore, in the case of the above example, it is determined as JDPOSWAIT=0 in step 709 (that is, NO), and then a determination is made as to whether the current crank angle position is the reference crank angle position of the learning sequence (step 710).

In this case, since it is determined in step 710 that the current crank angle position is the reference crank angle position of the learning sequence (that is, YES), interrupt processing is performed at the reference crank angle position of the learning sequence (step 711), and the control flow proceeds to step 708.

The interrupt processing in step 711 corresponds to the B75° (BTDC 75° CA) interrupt processing in the first embodiment of the present invention, and in this interrupt processing, fuel injection control processing, ignition timing control processing, etc., are performed.

Subsequently, the reference crank angle position detection waiting flag JDPOSWAIT is set to "1" (step 708), and the processing routine of FIG. 12 is ended.

When the flag JDPOSWAIT is set in step 708, the control unit 40 comes to the state of waiting for the detection of the reference crank angle position according to a lost tooth.

According to this waiting state, processing is performed in the order of the above-mentioned steps 701, 704 and 705 at each interrupt processing of the crank angle position until a reference crank angle position is detected by the following lost tooth.

On the other hand, when an untoothed position (reference crank angle position) is not detected in step 705, the control flow proceeds to the above-mentioned step 709 where if the reference crank angle position detection waiting flag JDPOSWAIT has been set, it is determined as JDPOSWAIT=1 (that is, YES), and the control flow proceeds to step 717.

In step 717, it is determined whether the number of pulses NP of the crank angle position signal (i.e., the number of pulses between successive reference crank angle positions) from the reference crank angle position according to the learning sequence to the reference crank angle position according to the actual detection of a lost tooth is greater than a third predetermined value N3 which is greater than a second predetermined number N2 to be described later.

In step 717, when determined as NP≦N3 (that is, NO), the processing routine of FIG. 12 is ended, whereas when determined as NP>N3 (that is, YES), this corresponds to the case where a lost tooth that should be detected has not been detected even if the control unit 40 continues waiting until the third predetermined value N3 is reached, so the learning sequence cylinder identification resetting processing is performed (step 718), and the processing routine of FIG. 12 is ended.

On the other hand, in step 705, when determined that an untoothed position (reference crank angle position) has been detected (that is, YES), it is further determined whether the reference crank angle position detection waiting flag JDPOSWAIT has been set (step 706).

In this case, since it is determined as JDPOSWAIT=1 (that is, YES), a determination is then made as to whether the number of pulses NP between successive reference crank angle positions is less than a first predetermined number N1 (step 712).

In step 712, when determined as NP<N1 (that is, YES), the untoothed position is reset to the reference crank angle position (step 715), and the reference crank angle position reset flag RSTPOS is set to "1" (step 716), while ending the processing routine of FIG. 12.

Next, an explanation will be made by taking, as an example, the case where the state in which the number of pulses of the crank angle position signal between successive lost teeth shown in FIG. 13 is less than that at normal time (i.e., an untoothed or lost tooth position has come earlier than the reference crank angle position of the learning sequence) appears for the first time after creation of the learning sequence.

First of all, processing is performed in the order of steps 701, 704 and 705 in FIG. 12 as referred to above.

In this case, since the position of the detected lost tooth comes earlier than the reference crank angle position of the learning sequence, it is determined in step 705 that an untoothed position (reference crank angle position) has been detected (that is, YES), and the control flow proceeds to step 706.

Subsequently, in step 706, it is determined as JDPOSWAIT=0 (that is, NO), and hence the control flow proceeds to step 707.

At this time, since the reference crank angle position of the learning sequence has not been detected, the current untoothed or lost tooth position is disregarded (step 707), and the reference crank angle position detection waiting flag JDPOSWAIT is then set (step 708), while ending the processing routine of FIG. 12.

After a learning sequence has been created, control is performed based on the reference crank angle position of the learning sequence, so processing is carried out as referred to above.

In this state, processing is performed in the order of the above-mentioned steps 701, 704, 705 and 706 at each interrupt processing of the crank angle position until the following lost tooth (reference crank angle position) is detected.

At this time, since the reference crank angle position detection waiting flag JDPOSWAIT has been set in the above-mentioned step 708, it is determined as JDPOSWAIT=1 in step 706 (that is, YES), and the control flow proceeds to step 712.

In step 712, when it is determined that the number of pulses NP between successive reference crank angle positions is equal to or greater than the first predetermined value N1 (NP≧N1) (that is, YES), then a determination is made as to whether the number of pulses NP between successive reference crank angle positions is greater than the second predetermined value N2 (N2>N1) (step 713).

In step 713, when it is determined as NP≦N2 (that is, NO), it is assumed that the detected untoothed position is greatly apart from the original untoothed position, so that the learning sequence cylinder identification resetting processing is performed (step 719), and the processing routine of FIG. 12 is ended.

On the other hand, in step 713, when determined as NP>N2 (that is, YES), the detected untoothed position is assumed to be an untoothed position of the following cylinder, so that the cylinder number is incremented (step 714), and the control flow proceeds to the above-mentioned step 715.

Thereafter, in step 715, the untoothed position is reset to the reference crank angle position, and then in step 716, the reference crank angle position reset flag RSTPOS is set, while ending the processing routine of FIG. 12.

As described above, when the respective reference crank angle positions are in disagreement with each other, the reference crank angle position of the learning sequence is re-set.

In addition, with the reference crank angle position reset flag RSTPOS having been set, when disagreement between the reference crank angle positions is determined again in step 701, processing is performed in the order of steps 701 and 704, and the control flow proceeds to step 719 where the cylinder identification resetting processing is carried out.

Moreover, though not illustrated here, when the reference crank angle position according to the untoothed position and the reference crank angle position according to the learning sequence are continuously in agreement with each other over a predetermined number of strokes, the reference crank angle position reset flag RSTPOS may be cleared to zero.

Next, a learning sequence cylinder determination resetting processing (steps 718 and 719) in FIG. 12 will be concretely described below while referring to a flow chart of FIG. 14.

Figure 14:
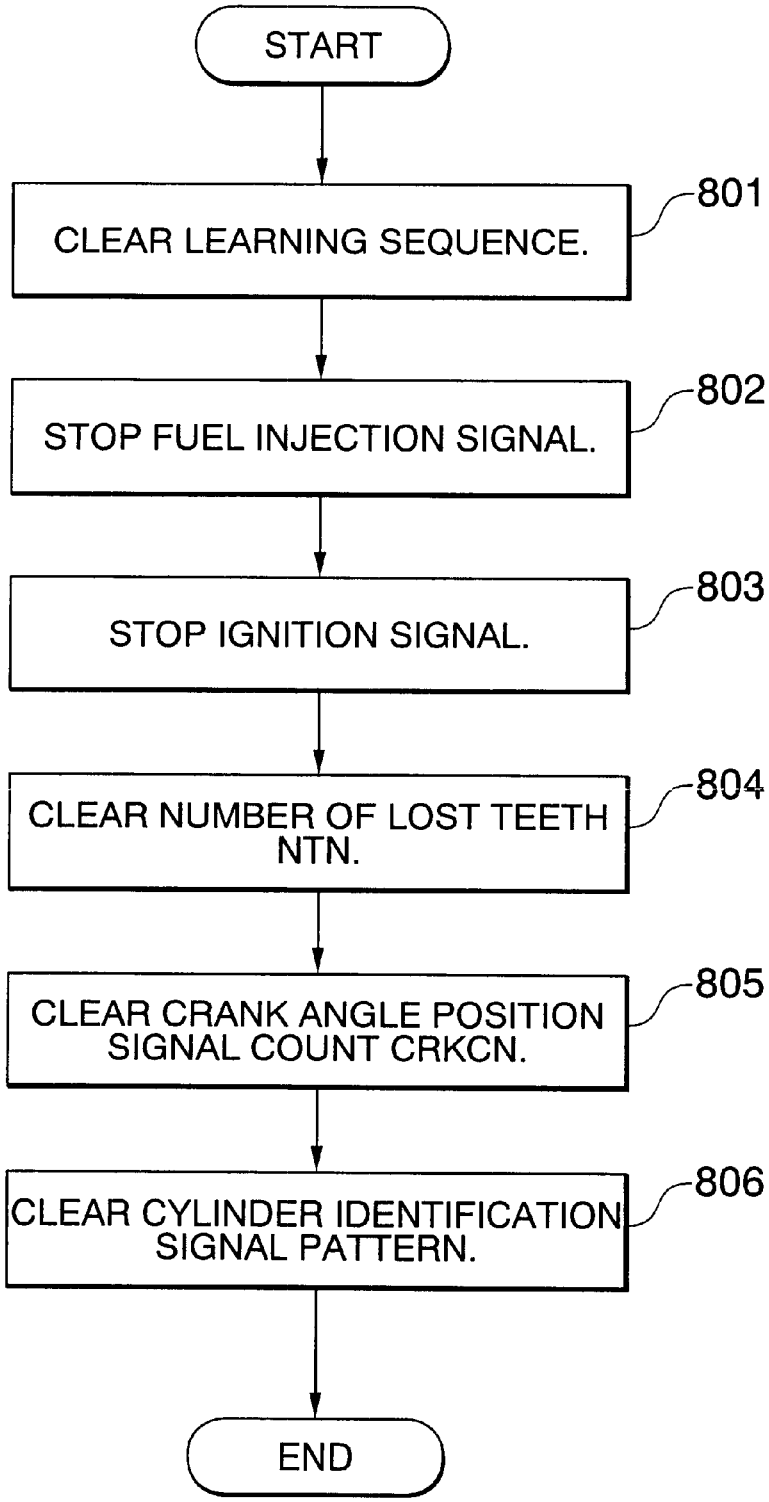
FIG. 14 is a flow chart illustrating a learning sequence cylinder identification resetting processing routine according to the first embodiment of the present invention.

In FIG. 14, steps 802 through 806 are the same processes as those in the above-mentioned steps 301 through 305, respectively (see FIG. 7).

First of all, the stored content (first cylinder sequence) of the first cylinder sequence storage means is cleared (step 801). At this time, the learning sequence is cleared such as by clearing the learning sequence creation counter LRNCNT to zero.

Subsequently, the fuel injection signal is stopped (step 802), the ignition signal is also stopped (step 803), the number of lost teeth NTN is cleared (step 804), the crank angle position signal counter CRKCN is also cleared (step 805), and the stored cylinder identification signal pattern is cleared, too (step 806). Thus, the processing routine of FIG. 14 is ended with the control unit 40 being made into a lost tooth detection waiting state.

When the learning sequence cylinder identification resetting processing of FIG. 14 is performed in this manner, real time cylinder identification is restarted from the following crank angle position.

Thus, in cases where there has sporadically taken place noise superposition, signal dropout, etc., in the crank angle position signal, the abnormality determination of the crank angle position signal using the learning sequence serves to prevent incorrect or false determination of the crank angle position, whereby the operation of the engine 10 can be continued.

Moreover, in cases where noise superposition, signal dropout, etc., might be continuously generated to cause a large error in the crank angle position, the engine 10 is stopped at once so that backfiring, engine damage or the like resulting from the continued operation of the engine 10 can be prevented beforehand.

In addition, even in cases where noise superposition, signal dropout, etc., might be intermittently generated, a minimum limp home function can be ensured by permitting the fuel injection control and the ignition timing control to be continued only in the cylinders (or periods) for which the crank angle position is correctly detected.

Now, a cylinder identification signal abnormality determination processing during and after creation of a learning sequence according to the first embodiment of the present invention will be described while referring to a flow chart of FIG. 15.

Figure 15:
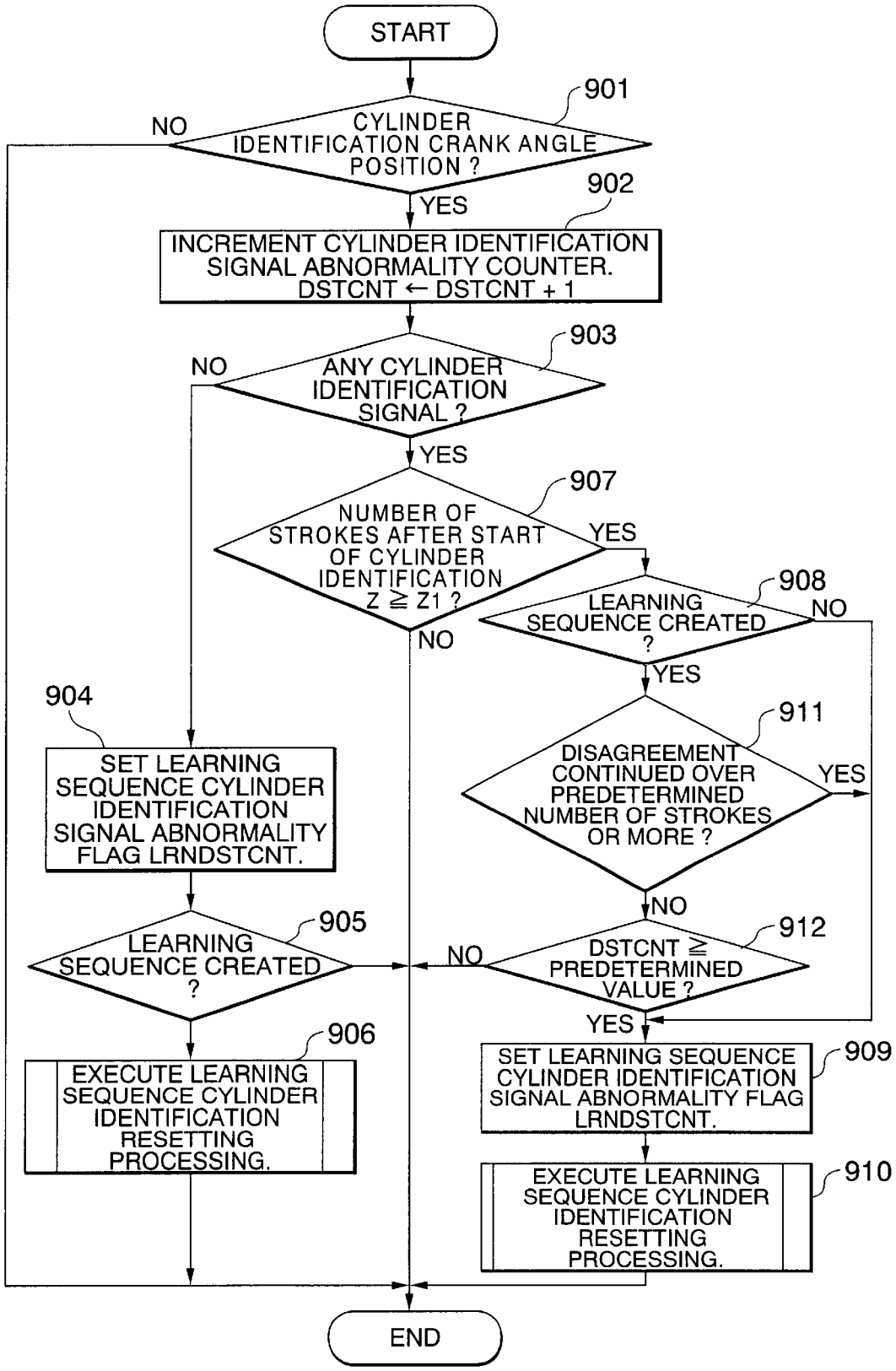
FIG. 15 is a flow chart illustrating an abnormality determination processing routine for the cylinder identification signal during and after the generation of a learning sequence according to the first embodiment of the present invention.

In this case, the control unit 40 is provided with a cylinder identification signal abnormality counter DSTCNT and a learning sequence cylinder identification signal abnormality flag LRNDSTCNT, and performs a processing routine of FIG. 15.

In FIG. 15, steps 906 and 910 are identical processing routines.

First, it is determined whether the current crank angle position is a cylinder identification crank angle position (step 901), and when determined that it is not a cylinder identification crank angle position (that is, NO), a determination as to whether the cylinder identification signal is normal or abnormal is impossible, and hence the processing routine of FIG. 15 is ended at once.

Moreover, in step 901, when determined that the current crank angle position is a cylinder identification crank angle position (that is, YES), the cylinder identification signal abnormality counter DSTCNT is incremented (step 902).

The cylinder identification signal abnormality counter DSTCNT is a counter that is incremented when there is disagreement between the result of the cylinder identification and the learning sequence, and though not illustrated, when the cylinder identification result and the learning sequence are continuously in agreement with each other over a predetermined number of strokes, the counter DSTCNT is cleared to zero.

Subsequently, the presence or absence of the cylinder identification signal is determined (step 903), and if determined that there is no input of the cylinder identification signal (that is, NO), it is assumed that the cylinder identification signal is abnormal, and hence the learning sequence cylinder identification signal abnormality flag LRNDSTCNT is set (step 904), and then it is determined whether a learning sequence has already been created (step 905).

In step 905, when determined that a learning sequence has already been created (that is, YES), the processing routine of FIG. 15 is ended.

At this time, it is possible to continue the control by updating the cylinder numbers according to the learning sequence with the abnormality determination flag having been set.

On the contrary, in step 905, when determined that any learning sequence has not yet been created (that is, NO), the learning sequence cylinder identification resetting processing similar to that in the above-mentioned steps 718 and 719 (see FIG. 12) is performed (step 906), and the processing routine of FIG. 15 is ended.

On the other hand, in step 903, when determined that there has been an input of the cylinder identification signal (that is, YES), it is further determined whether the number of strokes Z after the start of the cylinder identification is equal to or greater than a predetermined value Z1 (step 907).

The number of strokes Z after the start of the cylinder identification is counted by a counter which is made to count up when the cylinder identification is started immediately after engine starting or when the cylinder identification processing is restarted after the resetting processing of the cylinder identification has been executed.

In step 907, when determined as $Z<Z1$ (that is, NO), a determination is made that a learning sequence has not yet been created, and the processing routine of FIG. 15 is ended at once.

On the other hand, in step 907, when determined as Z≧Z1 (that is, YES), it is then determined whether a learning sequence has already been created (step 908).

In step 908, when no learning sequence has yet been created (that is, NO), it is assumed that the cylinder identification signal is abnormal, so that the learning sequence cylinder identification signal abnormality flag LRNDSTCNT is set (step 909), and the learning sequence cylinder identification resetting processing is performed (step 910), while ending the processing routine of FIG. 15.

On the other hand, in step 908, when determined that a learning sequence has already been created (that is, YES), then a determination is made whether the cylinder identification result and the cylinder sequence of the learning sequence have continuously been in disagreement with each other over a predetermined number of strokes or more (step 911).

In step 911, when determined that these cylinder sequences have continuously been in disagreement over the predetermined number of strokes or more (that is, YES), it is assumed that the cylinder identification signal is abnormal, and hence the above-mentioned steps 909, 910 are executed.

On the other hand, in step 911, when determined that the length of disagreement between the respective cylinder sequences is within the predetermined number of strokes (that is, NO), then a determination is made whether the count of the cylinder identification signal abnormality counter DSTCNT is equal to or more than a predetermined value (step 912).

In step 912, when determined as DSTCNT<the predetermined value (that is, NO), the processing routine of FIG. 15 is ended, whereas when determined as DSTCNT≧the predetermined value (that is, YES), it is assumed that the cylinder identification signal is abnormal, and hence the above-mentioned steps 909, 910 are executed.

Thus, in cases where there has sporadically taken place noise superposition, signal dropout, etc., in the cylinder identification signal, the abnormality determination of the cylinder identification signal using the learning sequence serves to prevent incorrect or false determination of the cylinder numbers, whereby the operation of the engine 10 can be continued.

In addition, in cases where the cylinder identification signal is determined to be abnormal in the absence of an input of the cylinder identification signal after creation of a learning sequence when the reference crank angle position of the learning sequence is determined to be normal according to a learning sequence abnormal state determination means, the cylinder numbers can be updated by the learning sequence.

Moreover, in cases where noise superposition, signal dropouts, etc., might be continuously generated to cause a shift or deviation in the cylinder numbers, the engine 10 is stopped at once so that backfiring, engine damage or the like resulting from the continued operation of the engine 10 can be prevented beforehand.

Further, even in cases where noise superposition, signal dropouts, etc., might be intermittently generated, a minimum limp home function can be ensured by permitting the fuel injection control and the ignition timing control to be continued only in the cylinders (or periods) for which cylinder identification has been correctly carried out.

Furthermore, though not illustrated herein, if a learning sequence is re-created after the learning sequence cylinder identification resetting processing has been executed, the reliability of the learning sequence can be further improved.

In addition, the cylinder identification means may include a learning sequence re-creation means for removing an abnormality determination of the cylinder identification signal and re-creating a learning sequence when the first and second cylinder sequences have continuously been in agreement with each other over a predetermined number of strokes after an abnormality determination of a learning sequence. In this case, by making the condition for re-creation of a learning sequence more stringent than the condition for ordinary creation of a learning sequence, it is possible to further improve the reliability of the learning sequence.

Moreover, the predetermined number of strokes for determining whether a learning sequence is to be re-created may be set to a value greater than the predetermined number of strokes for determining whether a learning sequence is to be ordinarily created. In this case, too, the reliability of the learning sequence can be further improved by making the condition for re-creation of the learning sequence more stringent than the condition for ordinary creation of the learning sequence.

As can be seen from the foregoing description, the present invention provides the following excellent advantages.

According to the present invention, there is provided an internal combustion engine control apparatus for identifying a plurality of cylinders of an internal combustion engine to control the injection of fuel and ignition timing with respect to each of the cylinders. The apparatus comprises: crank angle position signal generation means mounted on a crankshaft of the internal combustion engine for generating a crank angle position signal in the form of a train of a plurality of pulses corresponding to a plurality of rotational angle positions of the crankshaft; cylinder identification signal generation means mounted on a camshaft that rotates at a rate of one revolution per two revolutions of the crankshaft for generating a cylinder identification signal in the form of a train of a plurality of pulses corresponding to a plurality of rotational angle positions of the camshaft, and to the cylinders; reference crank angle position detection means for detecting reference crank angle positions included in the crank angle position signal; cylinder identification means for identifying each of the cylinders based on the cylinder identification signal; cylinder control means for generating a fuel injection signal and an ignition signal with respect to each of the cylinders based on the result of cylinder identification performed by the cylinder identification means and the crank angle position of the crank angle position signal; and abnormality determination means for determining the presence or absence of abnormality at least in the crank angle position signal. The cylinder identification means comprises cylinder identification resetting means for resetting the current cylinder identification content of the cylinder identification means when it is determined that the crank angle position signal is abnormal. The cylinder identification resetting means comprises: fuel injection and ignition signal stopping means for stopping the fuel injection signal and the ignition signal; and cylinder identification information clearing means for clearing previous cylinder identification information earlier than the last crank angle position signal at the time of the determination of abnormality. With this arrangement, it is possible to detect an abnormal state (noise superposition, signal dropouts, etc.) that might be generated in the crank angle position signal, thereby making it possible to ensure a fail safe function upon occurrence of abnormality in the crank angle position signal.

Preferably, when the cylinder identification signal has not been detected over a prescribed crank angle range, the abnormality determination means determines that the crank angle position signal is abnormal. Thus, it is possible to detect an abnormal state occurring in the crank angle position signal with high reliability, thereby making it possible to ensure a fail safe function upon occurrence of abnormality in the crank angle position signal.

Preferably, when a predetermined number of pulses of the crank angle position signal have not been detected within a prescribed angle range defined by successive ones of the reference crank angle positions, the abnormality determination means determines that the crank angle position signal is abnormal. Thus, it is possible to detect an abnormal state occurring in the crank angle position signal with high reliability, thereby making it possible to ensure a fail safe function upon occurrence of abnormality in the crank angle position signal.

Preferably, when any of the reference crank angle positions has not been detected over a prescribed crank angle range, the abnormality determination means determines that the crank angle position signal is abnormal. Thus, it is possible to detect an abnormal state occurring in the crank angle position signal with high reliability, thereby making it possible to ensure a fail safe function upon occurrence of abnormality in the crank angle position signal.

Preferably, the abnormality determination means determines whether the cylinder identification signal is abnormal, and when it is determined that the cylinder identification signal is abnormal while at least one of the fuel injection and the ignition timing is controlled, the cylinder identification resetting means stops the fuel injection signal and the ignition signal, and clears previous cylinder identification information earlier than the last crank angle position signal at the time of the abnormality determination of the cylinder identification signal. Thus, it is possible to detect an abnormal state occurring in the crank angle position signal or in the cylinder identification signal with high reliability, thereby making it possible to ensure a fail safe function upon occurrence of abnormality in the crank angle position signal or in the cylinder identification signal.

Preferably, when a crank angle position at which the cylinder identification signal has been detected is outside a predetermined range, the abnormality determination means determines that the cylinder identification signal is abnormal. Thus, it is possible to detect an abnormal state occurring in the crank angle position signal or in the cylinder identification signal with high reliability, thereby making it possible to ensure a fail safe function upon occurrence of abnormality in the crank angle position signal or in the cylinder identification signal.

Preferably, when a predetermined number of pulses or more of the cylinder identification signal have been detected within a predetermined range of the crank angle positions, the abnormality determination means determines that the cylinder identification signal is abnormal. Thus, it is possible to detect an abnormal state occurring in the crank angle position signal or in the cylinder identification signal with high reliability, thereby making it possible to ensure a fail safe function upon occurrence of abnormality in the crank angle position signal or in the cylinder identification signal.

Preferably, when a predetermined number of pulses or more of the cylinder identification signal have been detected between successive pulses of the crank angle position signal, the abnormality determination means determines that the cylinder identification signal is abnormal. Thus, it is possible to detect an abnormal state occurring in the crank angle position signal or in the cylinder identification signal with high reliability, thereby making it possible to ensure a fail safe function upon occurrence of abnormality in the crank angle position signal or in the cylinder identification signal.

Preferably, when a plurality of crank angle positions defined by the reference crank angle positions and the cylinder identification signal have not a prescribed positional relation, the abnormality determination means determines that the cylinder identification signal is abnormal. Thus, it is possible to detect an abnormal state occurring in the crank angle position signal or in the cylinder identification signal with high reliability, thereby making it possible to ensure a fail safe function upon occurrence of abnormality in the crank angle position signal or in the cylinder identification signal.

Preferably, the cylinder identification means comprises: first cylinder sequence storage means for successively updating and reading in the crank angle positions based on the crank angle position signal and the cylinder identification result obtained by the cylinder identification means to store them as a first cylinder sequence; second cylinder sequence storage means for storing in advance regular crank angle positions and a regular cylinder sequence as a second cylinder sequence; cylinder sequence comparison means for determining whether the first and second cylinder sequences are in agreement with each other; and learning sequence creation means for making the second cylinder sequence as a new learning sequence when the cylinder sequence comparison means determines that the first and second cylinder sequences have been in agreement with each other over a predetermined number of strokes. After the new learning sequence has thus been created, the angle position of the crank angle position signal and each of the cylinders are decided according to the new learning sequence. Thus, when an abnormal state has taken place sporadically, it is possible to prevent incorrect or false determination of the crank angle position and the cylinder identification, thus permitting the operation of the engine to be continued. In addition, when an abnormal state has taken place continuously, the engine operation is promptly stopped. Moreover, when an abnormal state has taken place intermittently, a minimum limp home function can be ensured by permitting the fuel injection control and the ignition timing control to be continued only in the cylinders or periods for which cylinder identification has been correctly carried out.

Preferably, the abnormality determination means comprises: reference crank angle position comparison means for comparing a reference crank angle position detected by the reference crank angle position detection means with the reference crank angle position decided according to the new learning sequence, and the abnormality determination means determines that the reference crank angle position of the learning sequence is abnormal when the reference crank angle position comparison means determines that the respective reference crank angle positions are in disagreement with each other. The cylinder identification means comprises: learning sequence re-setting means for re-setting, when the abnormality determination means determines that the reference crank angle position of the learning sequence is abnormal, the following reference crank angle position, which will be detected next time by the reference crank angle position detection means, as a reference crank angle position of the learning sequence; first cylinder number setting means for holding the cylinder numbers of the learning sequence when the abnormality determination means determines that the cylinder identification signal is abnormal and setting control cylinder numbers in the same manner as in the thus held cylinder numbers of the learning sequence when the number of pulses of the crank angle position signal detected from the reference crank angle position of the learning sequence to the following reference crank angle position to be detected next time is equal to or less than a first predetermined value; second cylinder number setting means for advancing the control cylinder numbers by one from the held cylinder numbers of the learning sequence when the number of pulses of the crank angle position signal is equal to or greater than a second predetermined value that is larger than the first predetermined value; and learning sequence cylinder identification resetting means for resetting the learning sequence creation means and the cylinder identification means by determining that the setting of the control cylinder numbers by the first and second cylinder number setting means is improper when the number of pulses of the crank angle position signal is between the first predetermined value and the second predetermined value, or when a reference crank angle position that should be detected has not been detected even if a number of pulses of the crank angle position signal, which is equal to a third predetermined value larger than the second predetermined value, have been detected from the reference crank angle position of the learning sequence. The learning sequence cylinder identification resetting means comprises: learning sequence information clearing means for clearing the learning sequence by clearing the stored content of the first cylinder sequence storage means; fuel injection and ignition signal stopping means for stopping the fuel injection signal and the ignition signal; and cylinder identification information clearing means for clearing previous cylinder identification information earlier than the last crank angle position signal when it is determined that the reference crank angle position of the learning sequence is abnormal. Thus, it is possible to ensure a fail safe function corresponding to the situation in which an abnormal state has occurred.

Preferably, in cases where the reference crank angle position comparison means determines that there is disagreement between the respective reference crank angle positions, when the cylinder at the reference crank angle position according to a learning sequence re-set by the learning sequence re-setting means and the first or second cylinder number setting means is in agreement with the result of the following cylinder identification to be carried out next time by the cylinder identification means, the abnormality determination means determines that the re-set learning sequence is normal, or when the cylinder at the reference crank angle position according to the re-set learning sequence is in disagreement with the result of the following cylinder identification to be carried out next time by the cylinder identification means, the abnormality determination means determines that the re-set learning sequence is abnormal. When the abnormality determination means determines that the crank angle position of the re-set learning sequence is abnormal, the learning sequence cylinder identification resetting means resets the learning sequence creation means and the cylinder identification means. Thus, it is possible to ensure a fail safe function corresponding to the situation in which an abnormal state has occurred.

Preferably, when the abnormality determination means determines that the reference crank angle position of the learning sequence is normal, and that the cylinder identification signal is abnormal, the learning sequence cylinder identification resetting means resets the learning sequence creation means and the cylinder identification means. Thus, when there has sporadically taken place abnormality in the cylinder identification signal, it is possible to prevent incorrect or false determination of the cylinder numbers based on an abnormality determination of the cylinder identification signal using the learning sequence, thus permitting the operation of the engine to be continued. In addition, when abnormality has taken place continuously, the engine operation is stopped at once. Moreover, when abnormality has taken place intermittently, a minimum limp home function can be ensured by permitting the fuel injection control and the ignition timing control to be continued only in the cylinders or periods for which cylinder identification has been correctly carried out.

Preferably, when the cylinder sequence comparison means determines that the respective crank angle positions of the first and second cylinder sequences are in agreement with each other, and when the learning sequence has not been created within a predetermined number of strokes, the abnormality determination means determines that the cylinder identification signal is abnormal. Thus, it is possible to ensure a fail safe function corresponding to the situation in which an abnormal state has occurred, based on an abnormality determination of the cylinder identification signal using the learning sequence.

Preferably, when the first and second cylinder sequences have continuously been in disagreement with each other over a predetermined number of strokes after the learning sequence creation means created the learning sequence, the abnormality determination means determines that the cylinder identification signal is abnormal. Thus, it is possible to ensure a fail safe function corresponding to the situation in which an abnormal state has occurred, based on an abnormality determination of the cylinder identification signal using the learning sequence.

Preferably, the abnormality determination means comprises an error counter and a learning sequence error counter setting means. The error counter is incremented when the first and second cylinder sequences becomes in disagreement with each other after the creation of the learning sequence by the learning sequence creation means. The learning sequence error counter setting means clears the error counter when the first and second cylinder sequences are always in agreement with each other while the camshaft makes one revolution. When the count value of the error counter according to the learning sequence error counter setting means becomes equal to or more than a predetermined value, the abnormality determination means determines that the cylinder identification signal is abnormal. Thus, it is possible to ensure a fail safe function corresponding to the situation in which an abnormal state has occurred, based on an abnormality determination of the cylinder identification signal using the learning sequence.

Preferably, when the abnormality determination means determines, due to the absence of an input of the cylinder identification signal after the creation of the learning sequence by the learning sequence creation means, that the cylinder identification signal is abnormal, the learning sequence cylinder identification resetting means decides the crank angle positions of the crank angle position signal and each of the cylinders according to the learning sequence. Thus, it is possible to ensure a fail safe function corresponding to the situation in which an abnormal state has occurred, based on an abnormality determination of the cylinder identification signal using the learning sequence.

Preferably, the cylinder identification means comprises a learning sequence re-creation means for removing the abnormality determination of the cylinder identification signal and re-creating a learning sequence when the first and second cylinder sequences have continuously been in agreement with each other over a predetermined number of strokes after it was determined that the learning sequence was abnormal. Thus, by making the condition for re-creation of a learning sequence more stringent than the condition for ordinary creation of a learning sequence, it is possible to further improve the reliability of the learning sequence.

Preferably, the predetermined number of strokes by which it is determined whether the learning sequence re-creation means is to re-create the learning sequence is set to be greater than the predetermined number of strokes by which it is determined whether the learning sequence creation means is to create the learning sequence. Thus, by making the condition for re-creation of a learning sequence more stringent than the condition for ordinary creation of a learning sequence, it is possible to further improve the reliability of the learning sequence.

While the invention has been described in terms of a preferred embodiment, those skilled in the art will recognize that the invention can be practiced with modifications within the spirit and scope of the appended claims.

What is claimed is:

1. An internal combustion engine control apparatus for identifying a plurality of cylinders of an internal combustion engine to control the injection of fuel and ignition timing with respect to each of said cylinders, said apparatus comprising:

crank angle position signal generation means mounted on a crankshaft of said internal combustion engine for generating a crank angle position signal in the form of a train of a plurality of pulses corresponding to a plurality of rotational angle positions of said crankshaft;

cylinder identification signal generation means mounted on a camshaft that rotates at a rate of one revolution per two revolutions of said crankshaft for generating a cylinder identification signal in the form of a train of a plurality of pulses corresponding to a plurality of rotational angle positions of said camshaft, and to said cylinders;

reference crank angle position detection means for detecting reference crank angle positions included in said crank angle position signal;

cylinder identification means for identifying each of said cylinders based on said cylinder identification signal;

cylinder control means for generating a fuel injection signal and an ignition signal with respect to each of said cylinders based on the result of cylinder identification performed by said cylinder identification means and the crank angle position of said crank angle position signal; and abnormality determination means for determining the presence or absence of abnormality at least in said crank angle position signal;

wherein said cylinder identification means comprises cylinder identification resetting means for resetting the current cylinder identification content of said cylinder identification means when it is determined that said crank angle position signal is abnormal; and said cylinder identification resetting means comprises:

fuel injection and ignition signal stopping means for stopping said fuel injection signal and said ignition signal; and cylinder identification information clearing means for clearing previous cylinder identification information earlier than the last crank angle position signal at the time of the determination of abnormality.

2. The internal combustion engine control apparatus according to claim 1, wherein when said cylinder identification signal has not been detected over a prescribed crank angle range, said abnormality determination means determines that said crank angle position signal is abnormal.

3. The internal combustion engine control apparatus according to claim 1, wherein when a predetermined number of pulses of said crank angle position signal have not been detected within a prescribed angle range defined by successive ones of said reference crank angle positions, said abnormality determination means determines that said crank angle position signal is abnormal.

4. The internal combustion engine control apparatus according to claim 1, wherein when any of said reference crank angle positions has not been detected over a prescribed crank angle range, said abnormality determination means determines that said crank angle position signal is abnormal.

5. The internal combustion engine control apparatus according to claim 1, wherein said abnormality determination means determines whether said cylinder identification signal is abnormal, and when it is determined that said cylinder identification signal is abnormal while at least one of said fuel injection and said ignition timing is controlled, said cylinder identification resetting means stops said fuel injection signal and said ignition signal, and clears previous cylinder identification information earlier than the last crank angle position signal at the time of the abnormality determination of said cylinder identification signal.

6. The internal combustion engine control apparatus according to claim 5, wherein when a crank angle position at which said cylinder identification signal has been detected is outside a predetermined range, said abnormality determination means determines that said cylinder identification signal is abnormal.

7. The internal combustion engine control apparatus according to claim 5, wherein when a predetermined number of pulses or more of said cylinder identification signal have been detected within a predetermined range of said crank angle positions, said abnormality determination means determines that said cylinder identification signal is abnormal.

8. The internal combustion engine control apparatus according to claim 5, wherein when a predetermined number of pulses or more of said cylinder identification signal have been detected between successive pulses of said crank angle position signal, said abnormality determination means determines that said cylinder identification signal is abnormal.

9. The internal combustion engine control apparatus according to claim 5, wherein when a plurality of crank angle positions defined by said reference crank angle positions and said cylinder identification signal have not a prescribed positional relation, said abnormality determination means determines that said cylinder identification signal is abnormal.

10. The internal combustion engine control apparatus according to claim 1, wherein said cylinder identification means comprises:

first cylinder sequence storage means for successively updating and reading in the crank angle positions based on said crank angle position signal and the cylinder identification result obtained by said cylinder identification means to store them as a first cylinder sequence;

second cylinder sequence storage means for storing in advance regular crank angle positions and a regular cylinder sequence as a second cylinder sequence;

cylinder sequence comparison means for determining whether said first and second cylinder sequences are in agreement with each other; and learning sequence creation means for making said second cylinder sequence as a new learning sequence when said cylinder sequence comparison means determines that said first and second cylinder sequences have been in agreement with each other over a predetermined number of strokes;

wherein after said new learning sequence has thus been created, the angle position of said crank angle position signal and each of said cylinders are decided according to said new learning sequence.

11. The internal combustion engine control apparatus according to claim 10, wherein said abnormality determination means comprises:

reference crank angle position comparison means for comparing a reference crank angle position detected by said reference crank angle position detection means with the reference crank angle position decided according to said new learning sequence, and said abnormality determination means determines that the reference crank angle position of said learning sequence is abnormal when said reference crank angle position comparison means determines that said respective reference crank angle positions are in disagreement with each other;

wherein said cylinder identification means comprises:

learning sequence re-setting means for re-setting, when said abnormality determination means determines that the reference crank angle position of said learning sequence is abnormal, the following reference crank angle position, which will be detected next time by said reference crank angle position detection means, as a reference crank angle position of said learning sequence;

first cylinder number setting means for holding the cylinder numbers of said learning sequence when said abnormality determination means determines that said cylinder identification signal is abnormal and setting control cylinder numbers in the same manner as in the thus held cylinder numbers of said learning sequence when the number of pulses of said crank angle position signal detected from the reference crank angle position of said learning sequence to the following reference crank angle position to be detected next time is equal to or less than a first predetermined value;

second cylinder number setting means for advancing said control cylinder numbers by one from the held cylinder numbers of said learning sequence when the number of pulses of said crank angle position signal is equal to or greater than a second predetermined value that is larger than said first predetermined value; and learning sequence cylinder identification resetting means for resetting said learning sequence creation means and said cylinder identification means by determining that the setting of said control cylinder numbers by said first and second cylinder number setting means is improper when the number of pulses of said crank angle position signal is between said first predetermined value and said second predetermined value, or when a reference crank angle position that should be detected has not been detected even if a number of pulses of said crank angle position signal, which is equal to a third predetermined value larger than said second predetermined value, have been detected from the reference crank angle position of said learning sequence;

wherein said learning sequence cylinder identification resetting means comprises:

learning sequence information clearing means for clearing said learning sequence by clearing the stored content of said first cylinder sequence storage means;

fuel injection and ignition signal stopping means for stopping said fuel injection signal and said ignition signal; and cylinder identification information clearing means for clearing previous cylinder identification information earlier than the last crank angle position signal when it is determined that the reference crank angle position of said learning sequence is abnormal.

12. The internal combustion engine control apparatus according to claim 11, wherein in cases where said reference crank angle position comparison means determines that there is disagreement between said respective reference crank angle positions, when the cylinder at the reference crank angle position according to a learning sequence re-set by said learning sequence re-setting means and said first or second cylinder number setting means is in agreement with the result of the following cylinder identification to be carried out next time by said cylinder identification means, said abnormality determination means determines that said re-set learning sequence is normal, or when the cylinder at the reference crank angle position according to said re-set learning sequence is in disagreement with the result of the following cylinder identification to be carried out next time by said cylinder identification means, said abnormality determination means determines that said re-set learning sequence is abnormal; and when said abnormality determination means determines that the crank angle position of said re-set learning sequence is abnormal, said learning sequence cylinder identification resetting means resets said learning sequence creation means and said cylinder identification means.

13. The internal combustion engine control apparatus according to claim 10, wherein when said abnormality determination means determines that the reference crank angle position of said learning sequence is normal, and that said cylinder identification signal is abnormal, said learning sequence cylinder identification resetting means resets said learning sequence creation means and said cylinder identification means.

14. The internal combustion engine control apparatus according to claim 13, wherein when said cylinder sequence comparison means determines that the respective crank angle positions of said first and second cylinder sequences are in agreement with each other, and when said learning sequence has not been created within a predetermined number of strokes, said abnormality determination means determines that said cylinder identification signal is abnormal.

15. The internal combustion engine control apparatus according to claim 13, wherein when said first and second cylinder sequences have continuously been in disagreement with each other over a predetermined number of strokes after said learning sequence creation means created said learning sequence, said abnormality determination means determines that said cylinder identification signal is abnormal.

16. The internal combustion engine control apparatus according to claim 13, wherein said abnormality determination means comprises an error counter and a learning sequence error counter setting means;

said error counter is incremented when said first and second cylinder sequences becomes in disagreement with each other after the creation of said learning sequence by said learning sequence creation means;

said learning sequence error counter setting means clears said error counter when said first and second cylinder sequences are always in agreement with each other while said camshaft makes one revolution; and when the count value of said error counter according to said learning sequence error counter setting means becomes equal to or more than a predetermined value, said abnormality determination means determines that said cylinder identification signal is abnormal.

17. The internal combustion engine control apparatus according to claim 10, wherein when said abnormality determination means determines, due to the absence of an input of said cylinder identification signal after the creation of said learning sequence by said learning sequence creation means, that said cylinder identification signal is abnormal, said learning sequence cylinder identification resetting means decides the crank angle positions of said crank angle position signal and each of said cylinders according to said learning sequence.

18. The internal combustion engine control apparatus according to claim 10, wherein said cylinder identification means comprises a learning sequence re-creation means for removing the abnormality determination of said cylinder identification signal and re-creating a learning sequence when said first and second cylinder sequences have continuously been in agreement with each other over a predetermined number of strokes after it was determined that said learning sequence was abnormal.

19. The internal combustion engine control apparatus according to claim 18, wherein said predetermined number of strokes by which it is determined whether said learning sequence re-creation means is to re-create said learning sequence is set to be greater than said predetermined number of strokes by which it is determined whether said learning sequence creation means is to create said learning sequence.

* * * * *